US008418725B2

(12) United States Patent
Schultz et al.

(10) Patent No.: US 8,418,725 B2
(45) Date of Patent: Apr. 16, 2013

(54) FLUIDIC OSCILLATORS FOR USE WITH A SUBTERRANEAN WELL

(75) Inventors: Roger L. Schultz, Ninnekah, OK (US); Robert Pipkin, Marlow, OK (US); Travis Cavender, Angleton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 159 days.

(21) Appl. No.: 12/983,153

(22) Filed: Dec. 31, 2010

(65) Prior Publication Data

US 2012/0167994 A1 Jul. 5, 2012

(51) Int. Cl.
*F15C 1/22* (2006.01)

(52) U.S. Cl.
USPC ..... 137/820; 137/810; 137/814; 137/834; 166/311; 166/90.1; 166/223

(58) Field of Classification Search ..... 137/820, 137/810, 814, 834; 166/311, 312, 90.1, 223
See application file for complete search history.

(56) References Cited

U.S. PATENT DOCUMENTS

| | | | | |
|---|---|---|---|---|
| 2,324,819 | A | 6/1941 | Butzbach | |
| 3,238,960 | A * | 3/1966 | Hatch, Jr. | 137/811 |
| 3,407,828 | A * | 10/1968 | Jones | 251/62 |
| 3,444,879 | A | 5/1969 | McLeod | |
| 3,563,462 | A | 2/1971 | Bauer | |
| 4,276,943 | A * | 7/1981 | Holmes | 175/40 |
| 4,291,395 | A * | 9/1981 | Holmes | 367/83 |
| 4,323,991 | A * | 4/1982 | Holmes et al. | 367/83 |
| 4,919,204 | A | 4/1990 | Baker et al. | |
| 5,135,051 | A | 8/1992 | Facteau et al. | |
| 5,165,438 | A | 11/1992 | Facteau et al. | |
| 5,184,678 | A | 2/1993 | Pechkov et al. | |
| 5,484,016 | A | 1/1996 | Surjaatmadja et al. | |
| 5,533,571 | A | 7/1996 | Surjaatmadja et al. | |
| 5,893,383 | A | 4/1999 | Facteau | |
| 6,015,011 | A | 1/2000 | Hunter | |

(Continued)

FOREIGN PATENT DOCUMENTS

| | | |
|---|---|---|
| EP | 0834342 A2 | 4/1998 |
| EP | 1857633 A2 | 11/2007 |

(Continued)

OTHER PUBLICATIONS

Office Action issued Aug. 14, 2012 for U.S. Appl. No. 12/983,145, 28 pages.

(Continued)

*Primary Examiner* — John Rivell
*Assistant Examiner* — Minh Le
(74) *Attorney, Agent, or Firm* — John W. Wustenberg; Smith IP Services, P.C.

(57) ABSTRACT

A well tool can comprise a fluid input, a fluid output and a fluidic oscillator which produces oscillations in a fluid which flows from the input to the output. The fluidic oscillator can include a vortex chamber with inlets, whereby fluid enters the vortex chamber alternately via the inlets, the inlets being configured so that the fluid enters the vortex chamber in different directions via the respective inlets, and a fluid switch which directs the fluid alternately toward different flow paths in response to pressure differentials between feedback fluid paths. The feedback fluid paths may be connected to the vortex chamber. The flow paths may cross each other between the fluid switch and the outlet.

20 Claims, 20 Drawing Sheets

U.S. PATENT DOCUMENTS

| | | | |
|---|---|---|---|
| 6,241,019 | B1 | 6/2001 | Davidson et al. |
| 6,336,502 | B1 | 1/2002 | Surjaatmadja et al. |
| 6,367,547 | B1 | 4/2002 | Towers et al. |
| 6,371,210 | B1 | 4/2002 | Bode et al. |
| 6,405,797 | B2 | 6/2002 | Davidson et al. |
| 6,619,394 | B2 | 9/2003 | Soliman et al. |
| 6,622,794 | B2 | 9/2003 | Zisk, Jr. |
| 6,627,081 | B1 | 9/2003 | Hilditch et al. |
| 6,644,412 | B2 | 11/2003 | Bode et al. |
| 6,691,781 | B2 | 2/2004 | Grant et al. |
| 6,719,048 | B1 | 4/2004 | Ramos et al. |
| 6,851,473 | B2 | 2/2005 | Davidson |
| 6,948,244 | B1 | 9/2005 | Crockett |
| 6,976,507 | B1 | 12/2005 | Webb et al. |
| 7,025,134 | B2 | 4/2006 | Byrd et al. |
| 7,114,560 | B2 | 10/2006 | Nguyen et al. |
| 7,185,706 | B2 | 3/2007 | Freyer |
| 7,213,650 | B2 | 5/2007 | Lehman et al. |
| 7,213,681 | B2 | 5/2007 | Birchak et al. |
| 7,216,738 | B2 | 5/2007 | Birchak et al. |
| 7,290,606 | B2 | 11/2007 | Coronado et al. |
| 7,318,471 | B2 | 1/2008 | Rodney et al. |
| 7,404,416 | B2 | 7/2008 | Schultz et al. |
| 7,404,441 | B2 | 7/2008 | Hocking |
| 7,405,998 | B2 | 7/2008 | Webb et al. |
| 7,409,999 | B2 | 8/2008 | Henriksen et al. |
| 7,413,010 | B2 | 8/2008 | Blauch et al. |
| 7,537,056 | B2 | 5/2009 | MacDougall |
| 2004/0256099 | A1 | 12/2004 | Nguyen et al. |
| 2006/0013427 | A1 | 1/2006 | Workman et al. |
| 2006/0039749 | A1 | 2/2006 | Gawehn |
| 2006/0108442 | A1 | 5/2006 | Russell et al. |
| 2007/0045038 | A1 | 3/2007 | Han et al. |
| 2007/0256828 | A1 | 11/2007 | Birchak et al. |
| 2008/0041580 | A1 | 2/2008 | Freyer et al. |
| 2008/0041581 | A1 | 2/2008 | Richards |
| 2008/0041582 | A1 | 2/2008 | Saetre et al. |
| 2008/0041588 | A1 | 2/2008 | Richards et al. |
| 2008/0142219 | A1 | 6/2008 | Steele et al. |
| 2008/0149323 | A1 | 6/2008 | O'Malley et al. |
| 2008/0283238 | A1 | 11/2008 | Richards et al. |
| 2009/0008088 | A1 | 1/2009 | Schultz et al. |
| 2009/0008090 | A1 | 1/2009 | Schultz et al. |
| 2009/0009297 | A1 | 1/2009 | Shinohara et al. |
| 2009/0009333 | A1 | 1/2009 | Bhogal et al. |
| 2009/0009336 | A1 | 1/2009 | Ishikawa |
| 2009/0009412 | A1 | 1/2009 | Warther |
| 2009/0009437 | A1 | 1/2009 | Hwang et al. |
| 2009/0009445 | A1 | 1/2009 | Lee |
| 2009/0009447 | A1 | 1/2009 | Naka et al. |
| 2009/0032260 | A1 | 2/2009 | Schultz et al. |
| 2009/0032267 | A1 | 2/2009 | Cavender et al. |
| 2009/0078427 | A1 | 3/2009 | Patel |
| 2009/0078428 | A1 | 3/2009 | Ali |
| 2009/0101354 | A1 | 4/2009 | Holmes et al. |
| 2009/0133869 | A1 | 5/2009 | Clem |
| 2009/0151925 | A1 | 6/2009 | Richards et al. |
| 2009/0159282 | A1 | 6/2009 | Webb et al. |
| 2009/0250224 | A1 | 10/2009 | Wright et al. |
| 2009/0277639 | A1 | 11/2009 | Schultz et al. |
| 2009/0277650 | A1 | 11/2009 | Casciaro et al. |
| 2010/0101773 | A1 | 4/2010 | Nguyen et al. |
| 2010/0252261 | A1 | 10/2010 | Cavender et al. |
| 2011/0042092 | A1 | 2/2011 | Fripp et al. |

FOREIGN PATENT DOCUMENTS

| | | | |
|---|---|---|---|
| WO | 0214647 | A1 | 2/2002 |
| WO | 03062597 | A1 | 7/2003 |
| WO | 2008024645 | A2 | 2/2008 |
| WO | 2009052076 | A2 | 4/2009 |
| WO | 2009052103 | A2 | 4/2009 |
| WO | 2009052149 | A2 | 4/2009 |
| WO | 2009081088 | A2 | 7/2009 |
| WO | 2009088292 | A1 | 7/2009 |
| WO | 2009088293 | A1 | 7/2009 |
| WO | 2009088624 | A2 | 7/2009 |

OTHER PUBLICATIONS

Joseph M. Kirchner, "Fluid Amplifiers", 1996, 6 pages, McGraw-Hill, New York.

Joseph M. Kirchner, et al., "Design Theory of Fluidic Components", 1975, 9 pages, Academic Press, New York.

Microsoft Corporation, "Fluidics" article, Microsoft Encarta Online Encyclopedia, copyright 1997-2009, 1 page, USA.

The Lee Company Technical Center, "Technical Hydraulic Handbook" 11th Edition, copyright 1971-2009, 7 pages, Connecticut.

Specification and Drawings for U.S. Appl. No. 10/650,186, filed Aug. 28, 2003, 16 pages.

Apparatus and Method of Inducing Fluidic Oscillation in a Rotating Cleaning Nozzle, ip.com, dated Apr. 24, 2007, 3 pages.

International Search Report with Written Opinion issued Apr. 12, 2012 for PCT Patent Application No. PCT/US11/053403, 17 pages.

Office Action issued Feb. 1, 2013 for U.S. Appl. No. 13/624,737, 50 pages.

Specification and drawings for U.S. Appl. No. 13/624,737, filed Sep. 21, 2012, 56 pages.

* cited by examiner

FLUIDIC OSCILLATORS FOR USE WITH A SUBTERRANEAN WELL

BACKGROUND

This disclosure relates generally to equipment utilized and operations performed in conjunction with a subterranean well and, in an example described below, more particularly provides improved configurations of fluidic oscillators.

There are many situations in which it would be desirable to produce oscillations in fluid flow in a well. For example, in steam flooding operations, pulsations in flow of the injected steam can enhance sweep efficiency. In production operations, pressure fluctuations can encourage flow of hydrocarbons through rock pores, and pulsating jets can be used to clean well screens. In stimulation operations, pulsating jet flow can be used to initiate fractures in formations. These are just a few examples of a wide variety of possible applications for oscillating fluid flow.

Therefore, it will be appreciated that improvements would be beneficial in the art of constructing fluidic oscillators.

SUMMARY

In the disclosure below, a well tool with a uniquely configured fluidic oscillator is provided which brings improvements to the art. One example is described below in which the fluidic oscillator includes a fluid switch and a vortex chamber. Another example is described below in which flow paths in the fluidic oscillator cross each other.

In one aspect, a well tool provided to the art by this disclosure can comprise a fluid input, a fluid output and a fluidic oscillator which produces oscillations in flow of a fluid between the input and the output. The fluidic oscillator can include a vortex chamber with inlets, whereby fluid enters the vortex chamber alternately via the inlets, the inlets being configured so that the fluid enters the vortex chamber in different directions via the respective inlets, and a fluid switch which directs the fluid alternately toward different flow paths in response to pressure differentials between feedback fluid paths.

The feedback fluid paths may be connected to the vortex chamber. The flow paths may cross each other between the fluid switch and the outlet.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
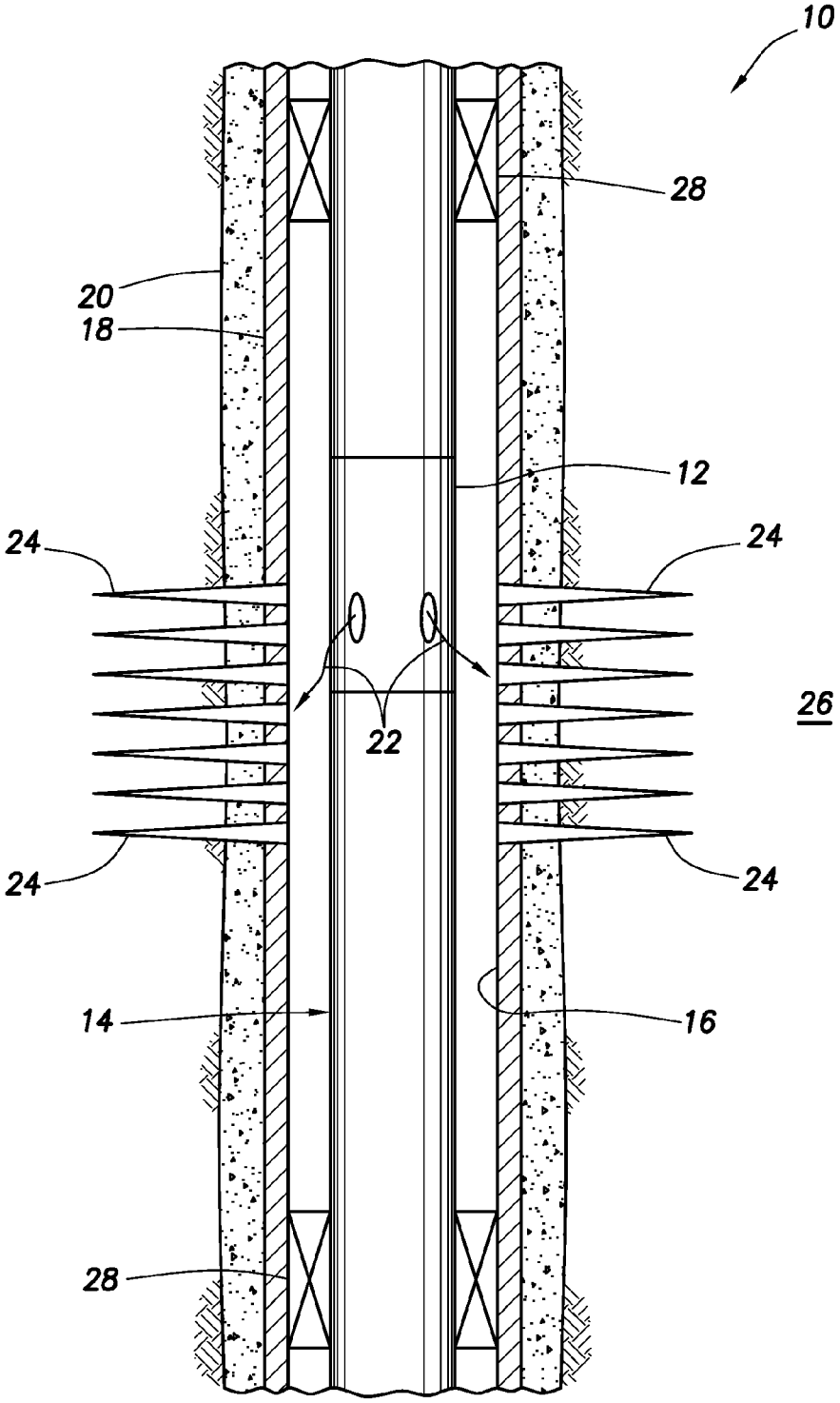
FIG. 1 is a representative partially cross-sectional view of a well system and associated method which can embody principles of the present disclosure.

Representatively illustrated in FIG. 1 is a well system 10 and associated method which can embody principles of this disclosure. In this example, a well tool 12 is interconnected in a tubular string 14 installed in a wellbore 16. The wellbore 16 is lined with casing 18 and cement 20. The well tool 12 is used to produce oscillations in flow of fluid 22 injected through perforations 24 into a formation 26 penetrated by the wellbore 16.

The fluid 22 could be steam, water, gas, fluid previously produced from the formation 26, fluid produced from another formation or another interval of the formation 26, or any other type of fluid from any source. It is not necessary, however, for the fluid 22 to be flowed outward into the formation 26 or outward through the well tool 12, since the principles of this disclosure are also applicable to situations in which fluid is produced from a formation, or in which fluid is flowed inwardly through a well tool.

Broadly speaking, this disclosure is not limited at all to the one example depicted in FIG. 1 and described herein. Instead, this disclosure is applicable to a variety of different circumstances in which, for example, the wellbore 16 is not cased or cemented, the well tool 12 is not interconnected in a tubular string 14 secured by packers 28 in the wellbore, etc.

Figure 2:
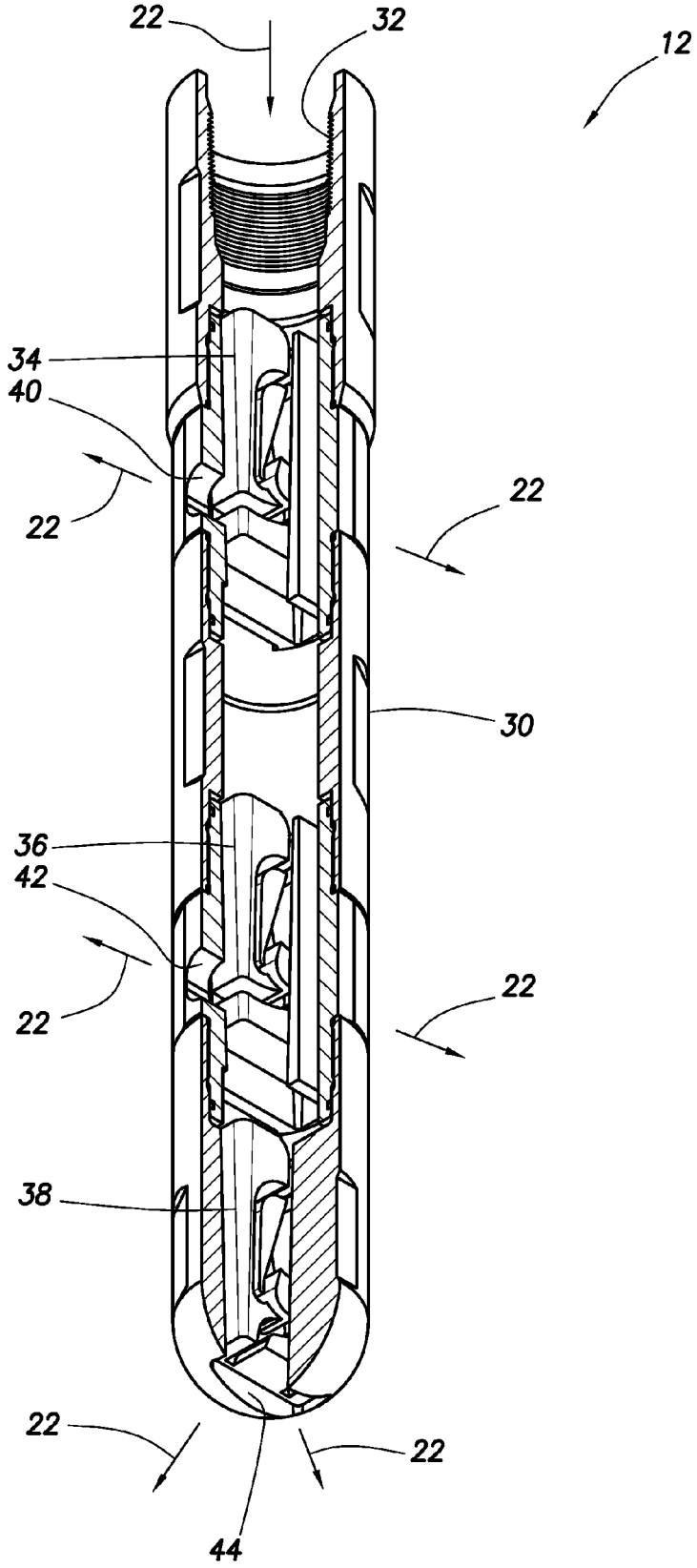
FIG. 2 is a representative partially cross-sectional isometric view of a well tool which may be used in the well system and method of FIG. 1.

Referring additionally now to FIG. 2, an example of the well tool 12 which may be used in the system 10 and method of FIG. 1 is representatively illustrated. However, the well tool 12 could be used in other systems and methods, in keeping with the principles of this disclosure.

The well tool 12 depicted in FIG. 2 has an outer housing assembly 30 with a threaded connector 32 at an upper end thereof. This example is configured for attachment at a lower end of a tubular string, and so there is not another connector at a lower end of the housing assembly 30, but one could be provided if desired.

Secured within the housing assembly 30 are three inserts 34, 36, 38. The inserts 34, 36, 38 produce oscillations in the flow of the fluid 22 through the well tool 12.

More specifically, the upper insert 34 produces oscillations in the flow of the fluid 22 outwardly through two opposing ports 40 (only one of which is visible in FIG. 2) in the housing assembly 30. The middle insert 36 produces oscillations in the flow of the fluid 22 outwardly through two opposing ports 42 (only one of which is visible in FIG. 2). The lower insert 38 produces oscillations in the flow of the fluid 22 outwardly through a port 44 in the lower end of the housing assembly 30.

Of course, other numbers and arrangements of inserts and ports, and other directions of fluid flow may be used in other examples. FIG. 2 depicts merely one example of a possible configuration of the well tool 12.

Figure 3:
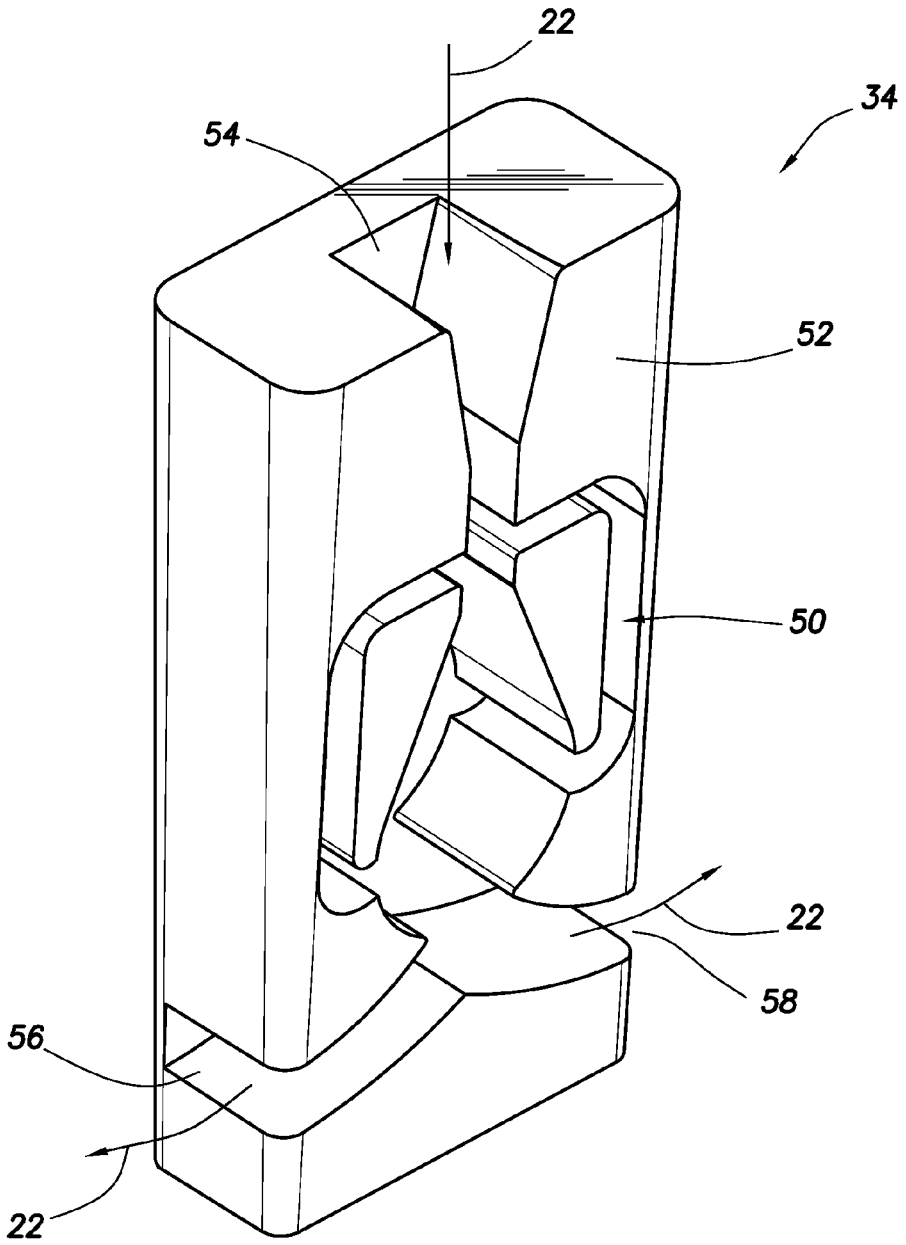
FIG. 3 is a representative isometric view of an insert which may be used in the well tool of FIG. 2.

Referring additionally now to FIG. 3, an enlarged scale view of one example of the insert 34 is representatively illustrated. The insert 34 may be used in the well tool 12 described above, or it may be used in other well tools in keeping with the principles of this disclosure.

The insert 34 depicted in FIG. 3 has a fluidic oscillator 50 machined, molded, cast or otherwise formed therein. In this example, the fluidic oscillator 50 is formed into a generally planar side 52 of the insert 34, and that side is closed off when the insert is installed in the well tool 12, so that the fluid oscillator is enclosed between its fluid input 54 and two fluid outputs 56, 58.

The fluid 22 flows into the fluidic oscillator 50 via the fluid input 54, and at least a majority of the fluid 22 alternately flows through the two fluid outputs 56, 58. That is, the majority of the fluid 22 flows outwardly via the fluid output 56, then it flows outwardly via the fluid output 58, then it flows outwardly through the fluid output 56, then through the fluid output 58, etc., back and forth repeatedly.

In the example of FIG. 3, the fluid outputs 56, 58 are oppositely directed (e.g., facing about 180 degrees relative to one another), so that the fluid 22 is alternately discharged from the fluidic oscillator 50 in opposite directions. In other examples (including some of those described below), the fluid outputs 56, 58 could be otherwise directed.

It also is not necessary for the fluid outputs 56, 58 to be structurally separated as in the example of FIG. 3. Instead, the fluid outputs 56, 58 could be different areas of a larger output opening as in the example of FIG. 7 described more fully below.

Figure 4:
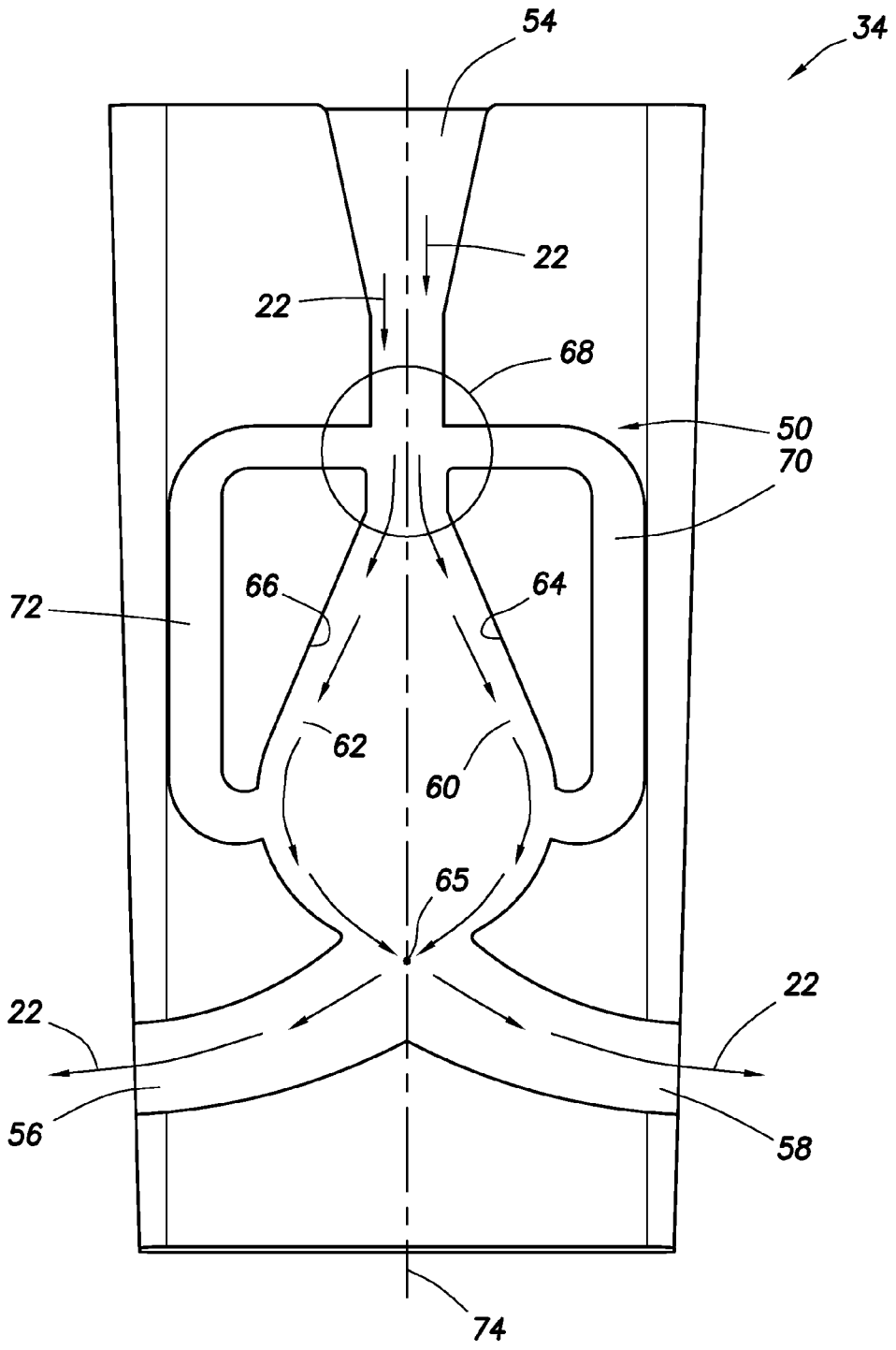
FIG. 4 is a representative elevational view of a fluidic oscillator formed in the insert of FIG. 3, which fluidic oscillator can embody principles of this disclosure.

Referring additionally now to FIG. 4, the fluidic oscillator 50 is representatively illustrated in an elevational view of the insert 34. However, it should be clearly understood that it is not necessary for the fluid oscillator 50 to be positioned in the insert 34 as depicted in FIG. 4, and the fluidic oscillator could be positioned in other inserts (such as the inserts 36, 38, etc.) or in other devices, in keeping with the principles of this disclosure.

The fluid 22 is received into the fluidic oscillator 50 via the inlet 54, and a majority of the fluid flows from the inlet to either the outlet 56 or the outlet 58 at any given point in time. The fluid 22 flows from the inlet 54 to the outlet 56 via one fluid path 60, and the fluid flows from the inlet to the other outlet 58 via another fluid path 62.

In one unique aspect of this example of the fluidic oscillator 50, the two fluid paths 60, 62 cross each other at a crossing 65. A location of the crossing 65 is determined by shapes of walls 64, 66 of the fluidic oscillator 50 which outwardly bound the flow paths 60, 62.

When a majority of the fluid 22 flows via the fluid path 60, the well-known Coanda effect tends to maintain the flow adjacent the wall 64. When a majority of the fluid 22 flows via the fluid path 62, the Coanda effect tends to maintain the flow adjacent the wall 66.

A fluid switch 68 is used to alternate the flow of the fluid 22 between the two fluid paths 60, 62. The fluid switch 68 is formed at an intersection between the inlet 54 and the two fluid paths 60, 62.

A feedback fluid path 70 is connected between the fluid switch 68 and the fluid path 60 downstream of the fluid switch and upstream of the crossing 65. Another feedback fluid path 72 is connected between the fluid switch 68 and the fluid path 62 downstream of the fluid switch and upstream of the crossing 65.

When pressure in the feedback fluid path 72 is greater than pressure in the other feedback fluid path 70, the fluid 22 will be influenced to flow toward the fluid path 60. When pressure in the feedback fluid path 70 is greater than pressure in the other feedback fluid path 72, the fluid 22 will be influenced to flow toward the fluid path 62. These relative pressure conditions are alternated back and forth, resulting in a majority of the fluid 22 flowing alternately via the fluid paths 60, 62.

For example, if initially a majority of the fluid 22 flows via the fluid path 60 (with the Coanda effect acting to maintain the fluid flow adjacent the wall 64), pressure in the feedback fluid path 70 will become greater than pressure in the feedback fluid path 72. This will result in the fluid 22 being influenced (in the fluid switch 68) to flow via the other fluid path 62.

When a majority of the fluid 22 flows via the fluid path 62 (with the Coanda effect acting to maintain the fluid flow adjacent the wall 66), pressure in the feedback fluid path 72 will become greater than pressure in the feedback fluid path 70. This will result in the fluid 22 being influenced (in the fluid switch 68) to flow via the other fluid path 60.

Thus, a majority of the fluid 22 will alternate between flowing via the fluid path 60 and flowing via the fluid path 62. Note that, although the fluid 22 is depicted in FIG. 4 as simultaneously flowing via both of the fluid paths 60, 62, in practice a majority of the fluid 22 will flow via only one of the fluid paths at a time.

Note that the fluidic oscillator 50 of FIG. 4 is generally symmetrical about a longitudinal axis 74. The fluid outputs 56, 58 are on opposite sides of the longitudinal axis 74, the feedback fluid paths 70, 72 are on opposite sides of the longitudinal axis, etc.

Figure 5:
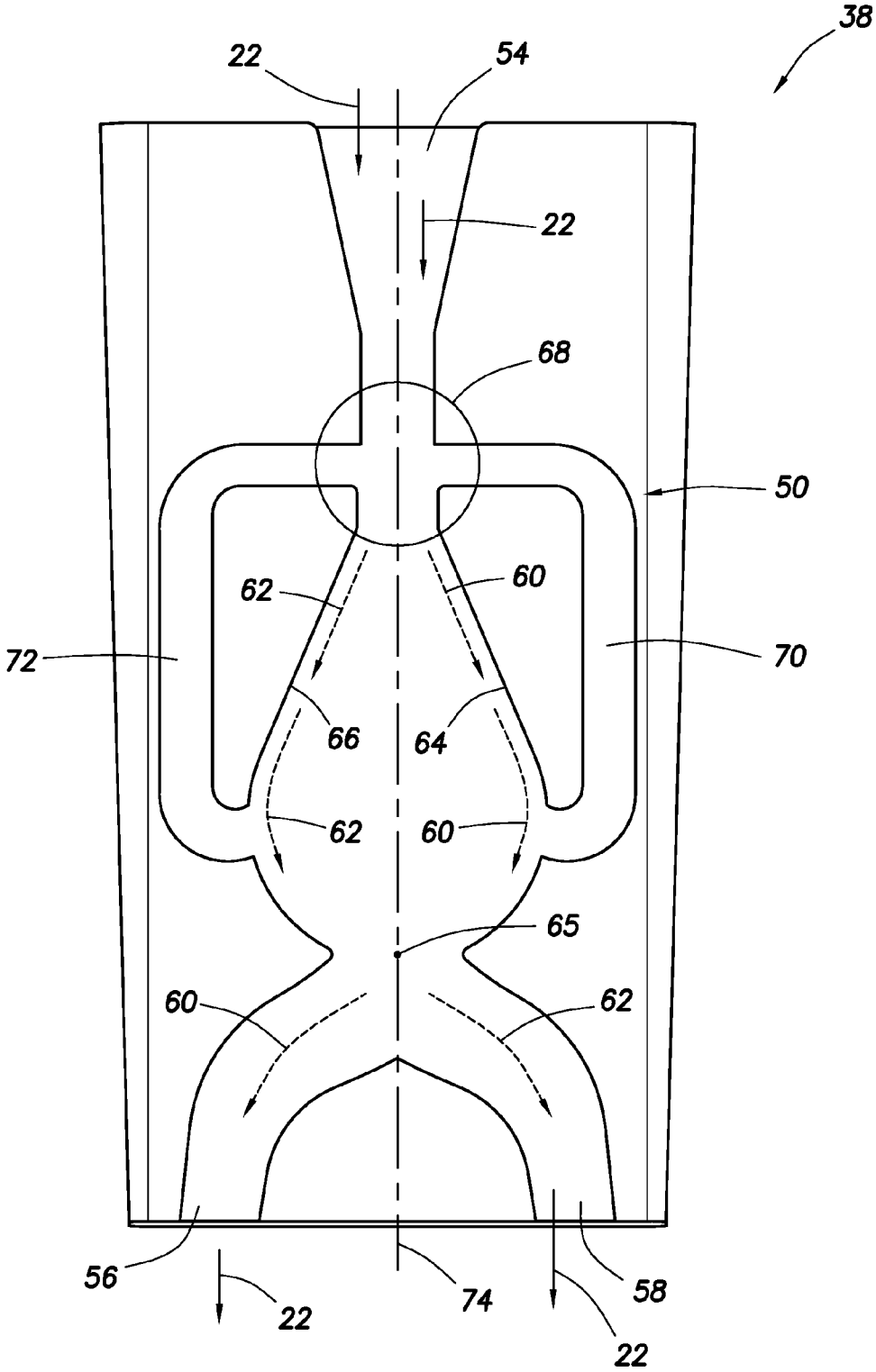
FIGS. 5-10 are additional configurations of the fluidic oscillator.

Referring additionally now to FIG. 5, another configuration of the fluidic oscillator 50 is representatively illustrated. In this configuration, the fluid outputs 56, 58 are not oppositely directed.

Instead, the fluid outputs 56, 58 discharge the fluid 22 in the same general direction (downward as viewed in FIG. 5). As such, the fluidic oscillator 50 of FIG. 5 would be appropriately configured for use in the lower insert 38 in the well tool 12 of FIG. 2.

Figure 6:
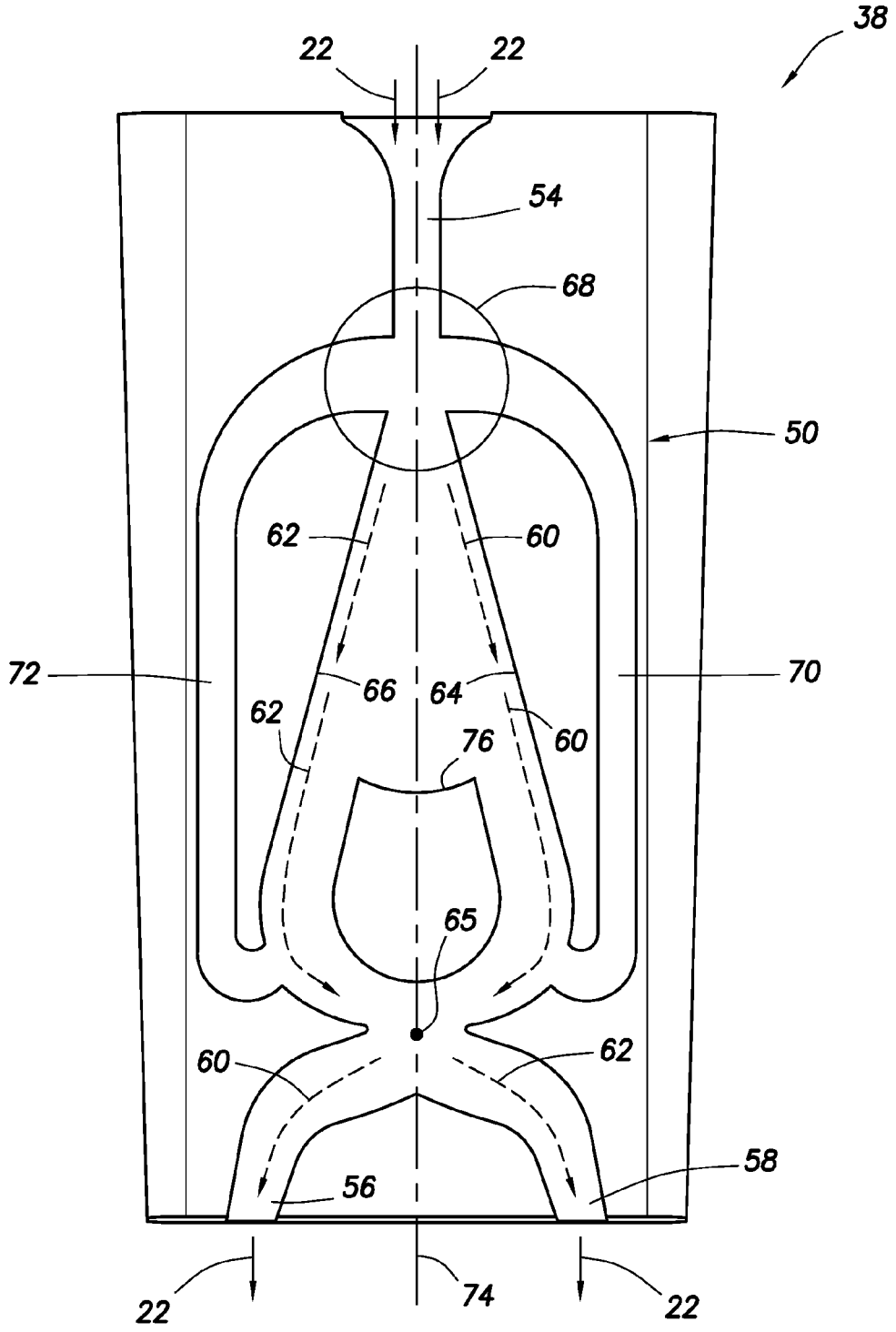

Referring additionally now to FIG. 6, another configuration of the fluidic oscillator 50 is representatively illustrated. In this configuration, a structure 76 is interposed between the fluid paths 60, 62 just upstream of the crossing 65.

The structure 76 beneficially reduces a flow area of each of the fluid paths 60, 62 upstream of the crossing 65, thereby increasing a velocity of the fluid 22 through the crossing and somewhat increasing the fluid pressure in the respective feedback fluid paths 70, 72.

This increased pressure is alternately present in the feedback fluid paths 70, 72, thereby producing more positive switching of fluid paths 60, 62 in the fluid switch 68. In addition, when initiating flow of the fluid 22 through the fluidic oscillator 50, an increased pressure difference between the feedback fluid paths 70, 72 helps to initiate the desired switching back and forth between the fluid paths 60, 62.

Figure 7:
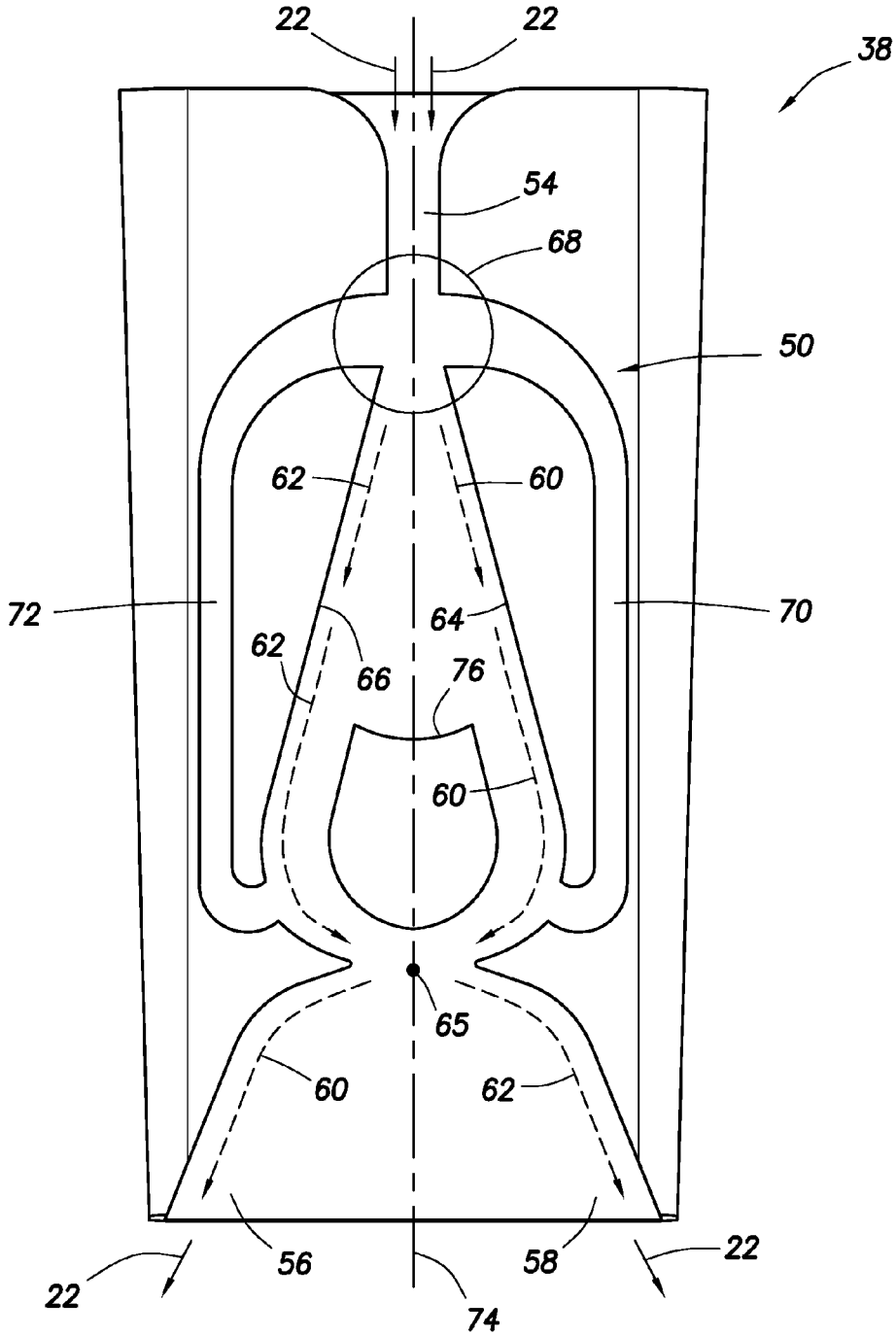

Referring additionally now to FIG. 7, another configuration of the fluidic oscillator 50 is representatively illustrated. In this configuration, the fluid outputs 56, 58 are not separated by any structure.

However, a majority of the fluid 22 will exit the fluidic oscillator 50 of FIG. 7 via either the fluid path 60 or the fluid path 62 at any given time. Therefore, the fluid outputs 56, 58 are defined by the regions of the fluidic oscillator 50 via which the fluid 22 exits the fluidic oscillator along the respective fluid paths 60, 62.

Figure 8:
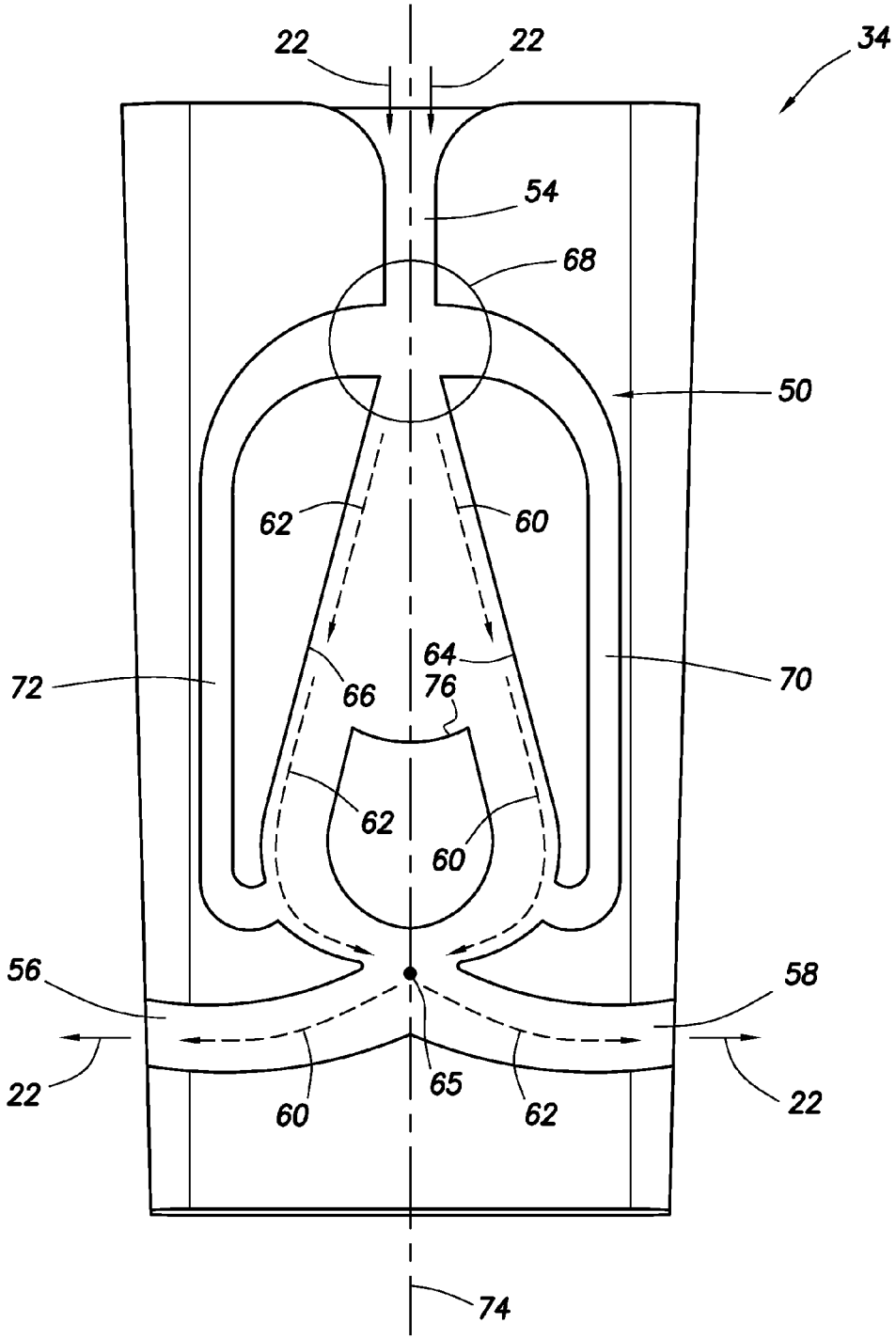

Referring additionally now to FIG. 8, another configuration of the fluidic oscillator is representatively illustrated. In this configuration, the fluid outputs 56, 58 are oppositely directed, similar to the configuration of FIG. 4, but the structure 76 is interposed between the fluid paths 60, 62, similar to the configuration of FIGS. 6 & 7.

Thus, the FIG. 8 configuration can be considered a combination of the FIGS. 4, 6 & 7 configurations. This demonstrates that any of the features of any of the configurations described herein can be used in combination with any of the other configurations, in keeping with the principles of this disclosure.

Figure 9:
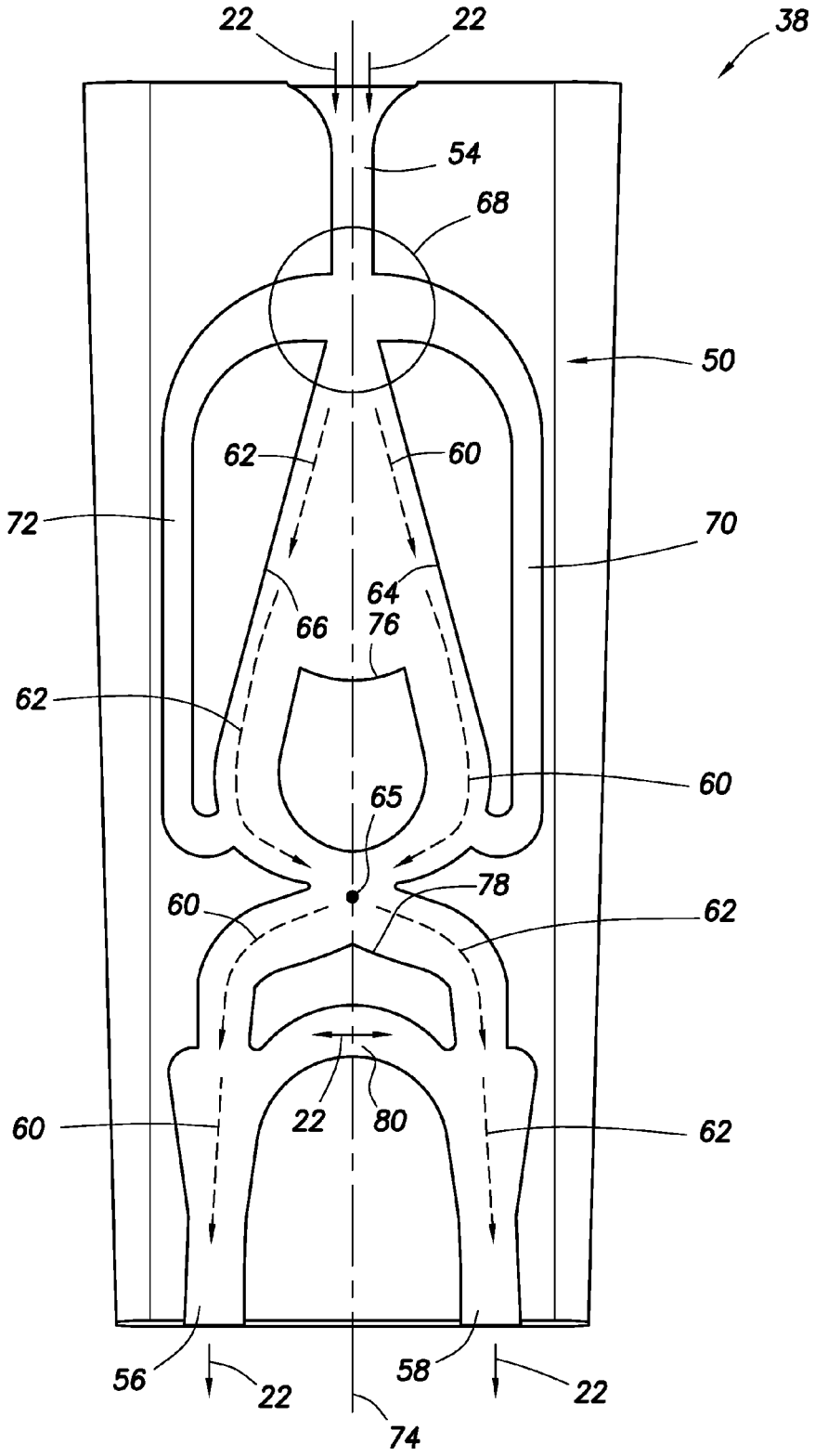

Referring additionally now to FIG. 9, another configuration of the fluidic oscillator 50 is representatively illustrated. In this configuration, another structure 78 is interposed between the fluid paths 60, 62 downstream of the crossing 65.

The structure 78 reduces the flow areas of the fluid paths 60, 62 just upstream of a fluid path 80 which connects the fluid paths 60, 62. The velocity of the fluid 22 flowing through the fluid paths 60, 62 is increased due to the reduced flow areas of the fluid paths.

The increased velocity of the fluid 22 flowing through each of the fluid paths 60, 62 can function to draw some fluid from the other of the fluid paths. For example, when a majority of the fluid 22 flows via the fluid path 60, its increased velocity due to the presence of the structure 78 can draw some fluid through the fluid path 80 into the fluid path 60. When a majority of the fluid 22 flows via the fluid path 62, its increased velocity due to the presence of the structure 78 can draw some fluid through the fluid path 80 into the fluid path 62.

It is possible that, properly designed, this can result in more fluid being alternately discharged from the fluid outputs 56, 58 than fluid 22 being flowed into the input 54. Thus, fluid can be drawn into one of the outputs 56, 68 while fluid is being discharged from the other of the outputs.

Figure 10:
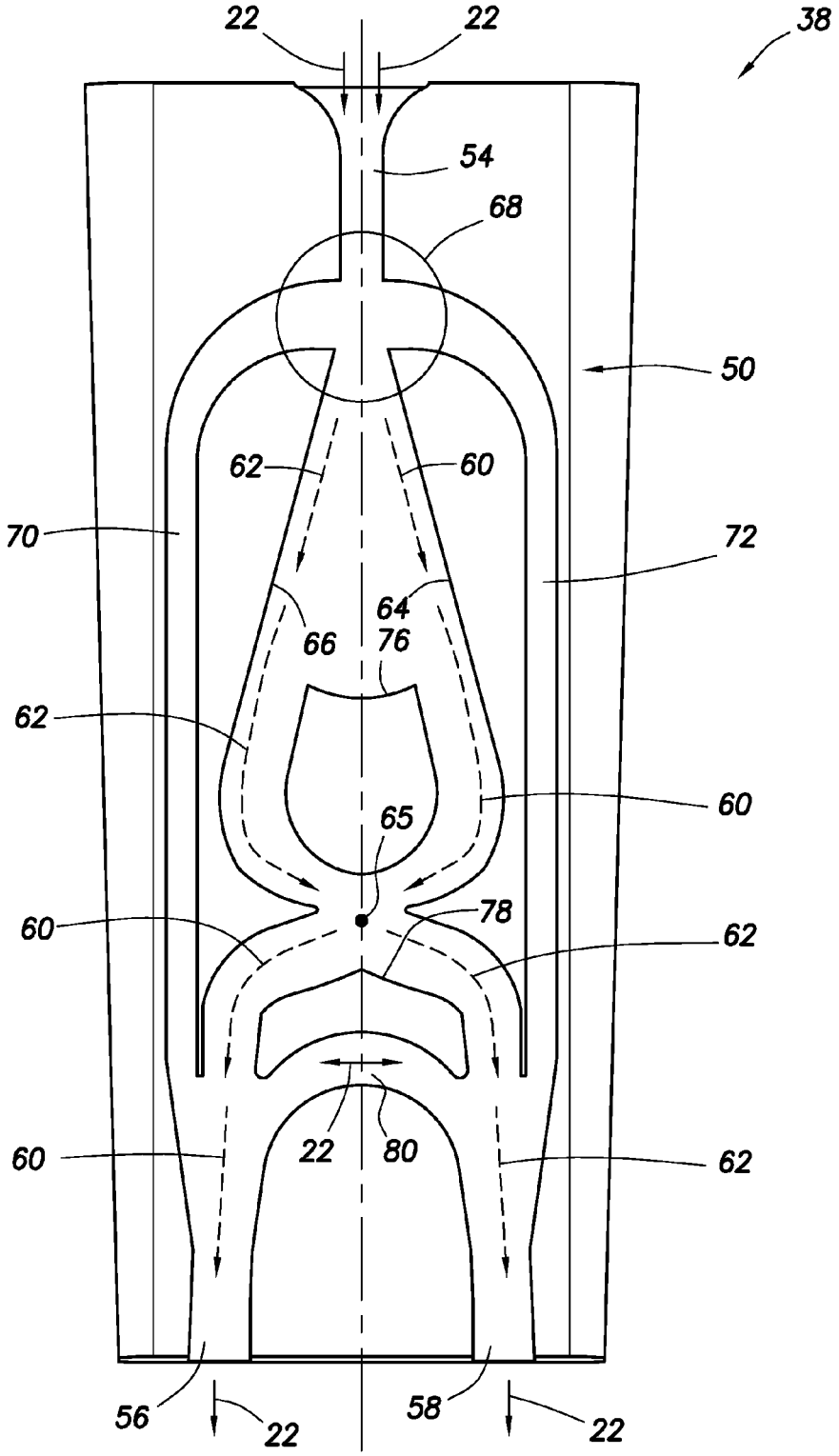

Referring additionally now to FIG. 10, another configuration of the fluidic oscillator 50 is representatively illustrated. In this configuration, computational fluid dynamics modeling has shown that a flow rate of fluid discharged from one of the outputs 56, 58 can be greater than a flow rate of fluid 22 directed into the input 54.

Fluid can be drawn from one of the outputs 56, 58 to the other output via the fluid path 80. Thus, fluid can enter one of the outputs 56, 58 while fluid is being discharged from the other output.

This is due in large part to the increased velocity of the fluid 22 caused by the structure 78 (e.g., the increased velocity of the fluid in one of the fluid paths 60, 62 causes reduction of fluid from the other of the fluid paths 60, 62 via the fluid path 80). At the intersections between the fluid paths 60, 62 and the respective feedback fluid paths 70, 72, pressure can be significantly reduced due to the increased velocity, thereby reducing pressure in the respective feedback fluid paths.

In the FIG. 10 example, a reduction in pressure in the feedback fluid path 70 will influence the fluid 22 to flow via the fluid path 62 from the fluid switch 68 (due to the relatively higher pressure in the other feedback fluid path 72). Similarly, a reduction in pressure in the feedback fluid path 72 will influence the fluid 22 to flow via the fluid path 60 from the fluid switch 68 (due to the relatively higher pressure in the other feedback fluid path 70).

One difference between the FIGS. 9 & 10 configurations is that, in the FIG. 10 configuration, the feedback fluid paths 70, 72 are connected to the respective fluid paths 60, 62 downstream of the crossing 65. Computational fluid dynamics modeling has shown that this arrangement produces desirably low frequency oscillations of flow from the outputs 56, 58, although such low frequency oscillations are not necessary in keeping with the principles of this disclosure.

Referring additionally now to FIGS. 11-19, another configuration of the fluidic oscillator 50 is representatively illustrated. As with the other configurations described herein, the fluidic oscillator 50 of FIGS. 11-19 can be used with the well tool 12 in the well system 10 and associated method, or the fluidic oscillator can be used with other well systems, well tools and methods.

In the FIGS. 11-19 configuration, the fluidic oscillator 50 includes a vortex chamber 80 having two inlets 82, 84. When the fluid 22 flows along the flow path 60, the fluid enters the vortex chamber 80 via the inlet 82. When the fluid 22 flows along the flow path 62, the fluid enters the vortex chamber 80 via the inlet 84.

The crossing 65 is depicted as being at an intersection of the inlets 82, 84 and the vortex chamber 80. However, the crossing 65 could be at another location, could be before or after the inlets 82, 84 intersect the vortex chamber 80, etc. It is not necessary for the inlets 82, 84 and the vortex chamber 80 to intersect at only a single location.

The inlets 82, 84 direct the fluid 22 to flow into the vortex chamber 80 in opposite circumferential directions. A tendency of the fluid 22 to flow circumferentially about the chamber 80 after entering via the inlets 82, 84 is related to many factors, such as, a velocity of the fluid, a density of the fluid, a viscosity of the fluid, a pressure differential between the input 54 and the output 56, a flow rate of the fluid between the input and the outlet, etc.

As the fluid 22 flows more radially from the inlets 82, 84 to the output 56, the pressure differential between the input 54 and the output 56 decreases, and a flow rate from the input to the output increases. As the fluid 22 flows more circumferentially about the chamber 80, the pressure differential between the input 54 and the output 56 increases, and the flow rate from the input to the output decreases.

This fluidic oscillator 50 takes advantage of a lag between the fluid 22 entering the vortex chamber 80 and full development of a vortex (spiraling flow of the fluid from the inlets 82, 84 to the output 56) in the vortex chamber. The feedback fluid paths 70, 72 are connected between the fluid switch 68 and the vortex chamber 80, so that the fluid switch will respond (at least partially) to creation or dissipation of a vortex in the vortex chamber.

Figure 11:
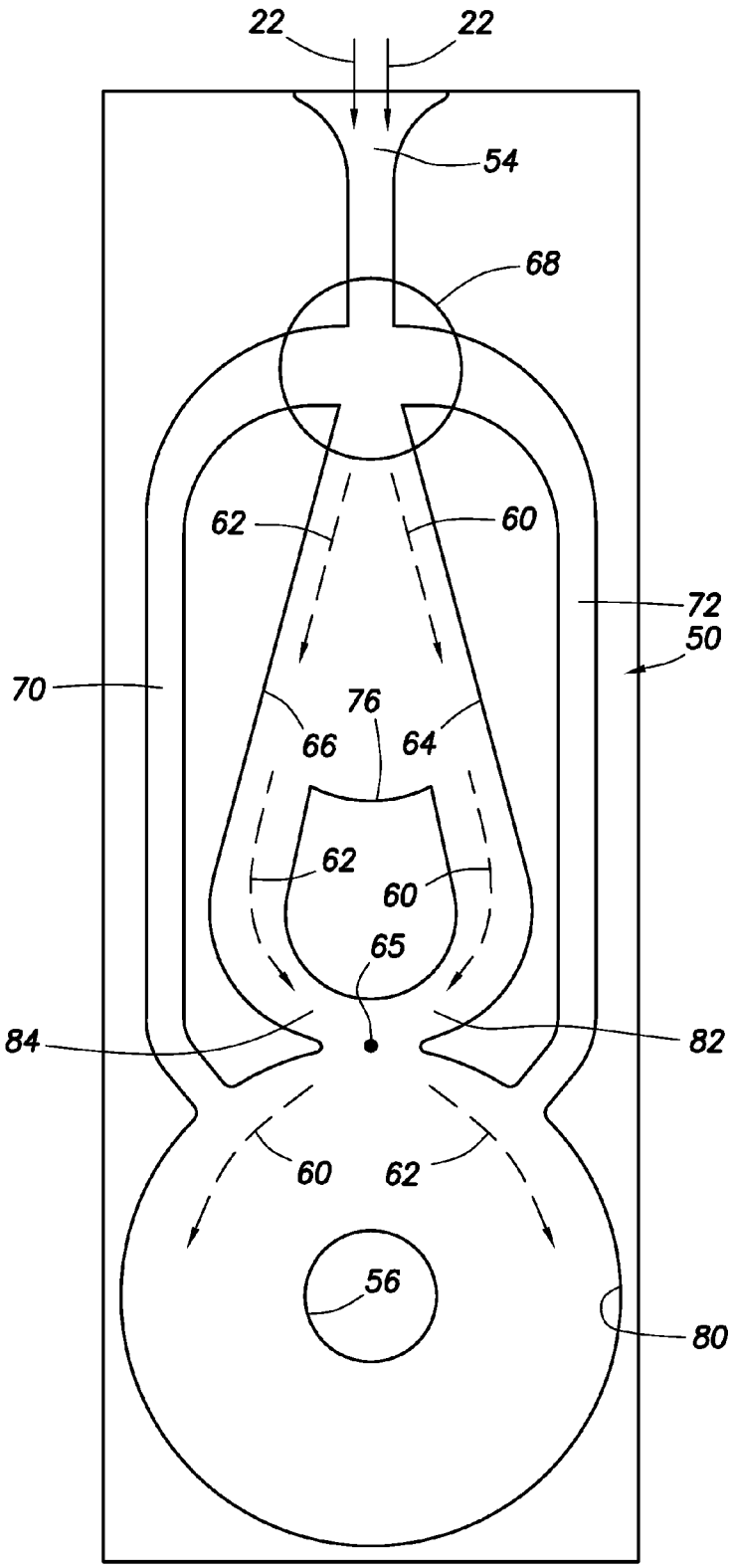
FIGS. 11-19 are representative partially cross-sectional views of another configuration of the fluidic oscillator.

FIGS. 12-19 representatively illustrate how the fluidic oscillator 50 of FIG. 11 creates pressure and/or flow rate oscillations in the fluid 22. As with the other fluidic oscillator 50 configurations described herein, such pressure and/or flow rate oscillations can be used for a variety of purposes. Some of these purposes can include: 1) to preferentially flow a desired fluid, 2) to reduce flow of an undesired fluid, 3) to determine viscosity of the fluid 22, 4) to determine the composition of the fluid, 5) to cut through a formation or other material with pulsating jets, 6) to generate electricity in response to vibrations or force oscillations, 7) to produce pressure and/or flow rate oscillations in produced or injected fluid flow, 8) for telemetry (e.g., to transmit signals via pressure and/or flow rate oscillations), 9) as a pressure drive for a hydraulic motor, 10) to clean well screens with pulsating flow, 11) to clean other surfaces with pulsating jets, 12) to promote uniformity of a gravel pack, 13) to enhance stimulation operations (e.g., acidizing, conformance or consolidation treatments, etc.), 14) any other operation which can be enhanced by oscillating flow rate, pressure, and/or force or displacement produced by oscillating flow rate and/or pressure, etc.

When the fluid 22 begins flowing through the fluidic oscillator 50 of FIG. 11, a fluid jet will be formed which extends through the fluid switch 68. Eventually, due to the Coanda effect, the fluid jet will tend to flow adjacent one of the walls 64, 66.

Assume for this example that the fluid jet eventually flows adjacent the wall 66. Because of this, a majority of the fluid 22 will flow along the flow path 62.

A majority of the fluid 22 will, thus, enter the vortex chamber 80 via the inlet 84. At this point, a vortex has not yet formed in the vortex chamber 80, and so a pressure differential from the input 54 to the output 56 is relatively low, and a flow rate of the fluid through the fluidic oscillator 50 is relatively high.

The fluid 22 can flow substantially radially from the inlet 84 to the outlet 56. Eventually, however, a vortex does form in the vortex chamber 80 and resistance to flow through the vortex chamber is thereby increased.

Figure 12:
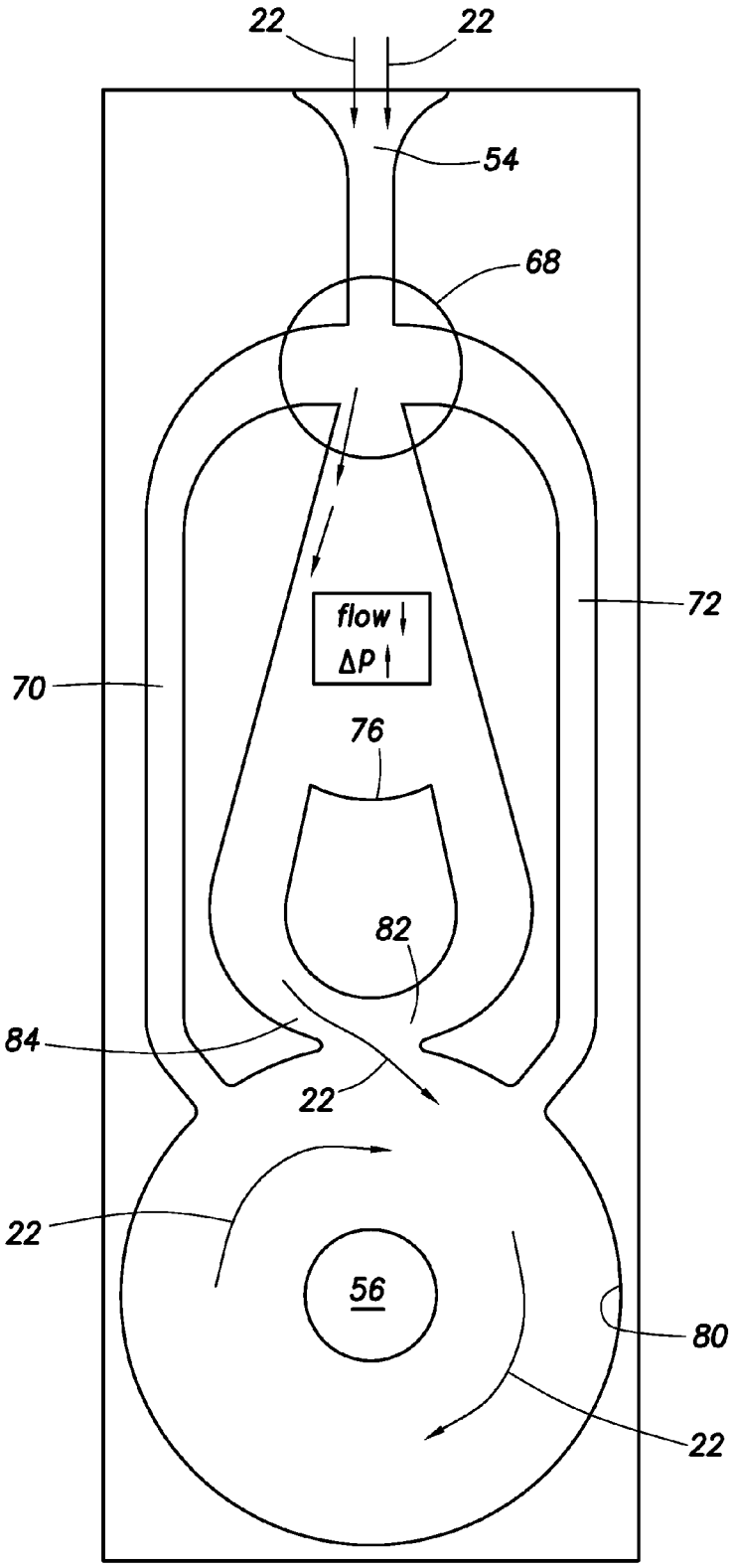

In FIG. 12, the fluidic oscillator 50 is depicted after a vortex has formed in the chamber 80. The fluid 22 now flows substantially circumferentially about the chamber 80 before exiting via the output 56.

The vortex is increasing in strength in the chamber 80, and so the fluid 22 is flowing more circumferentially about the chamber (in the clockwise direction as viewed in FIG. 12). A resistance to flow through the vortex chamber 80 results, and the pressure differential from the input 54 to the output 56 increases and/or the flow rate of the fluid 22 through the fluidic oscillator 50 decreases.

Figure 13:
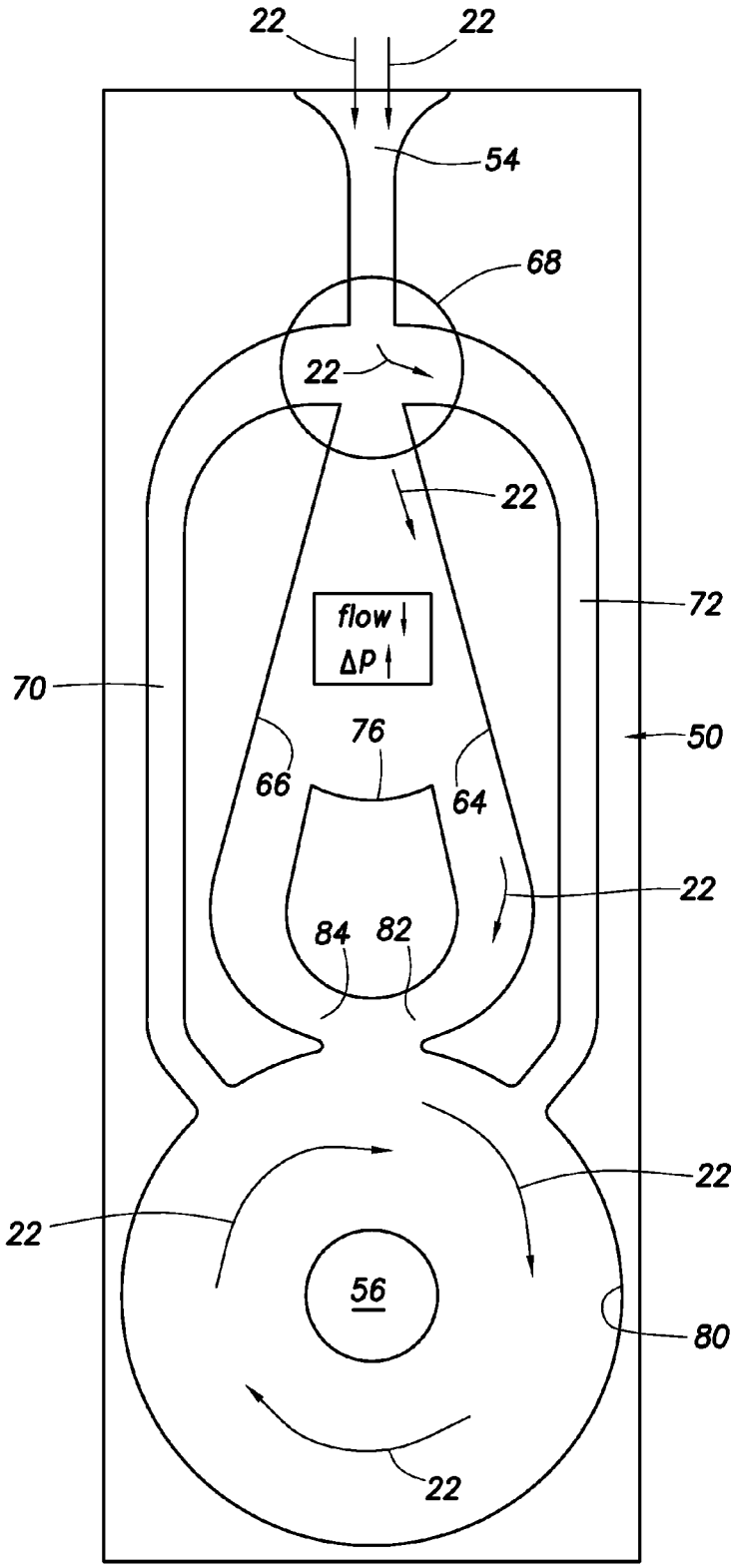

In FIG. 13, the vortex in the chamber 80 has reached maximum strength. Resistance to flow through the vortex chamber is at its maximum. Pressure differential from the input 54 to the output 56 may be at its maximum. The flow rate of the fluid 22 through the fluidic oscillator 50 may be at its minimum.

Eventually, however, due to the flow of the fluid 22 past the connection between the feedback fluid path 72 and the chamber 80, some of the fluid begins to flow from the fluid switch 68 to the chamber via the feedback fluid path. The fluid 22 also begins to flow adjacent the wall 64.

The vortex in the chamber 80 will begin to dissipate. As the vortex dissipates, the resistance to flow through the chamber 80 decreases.

Figure 14:
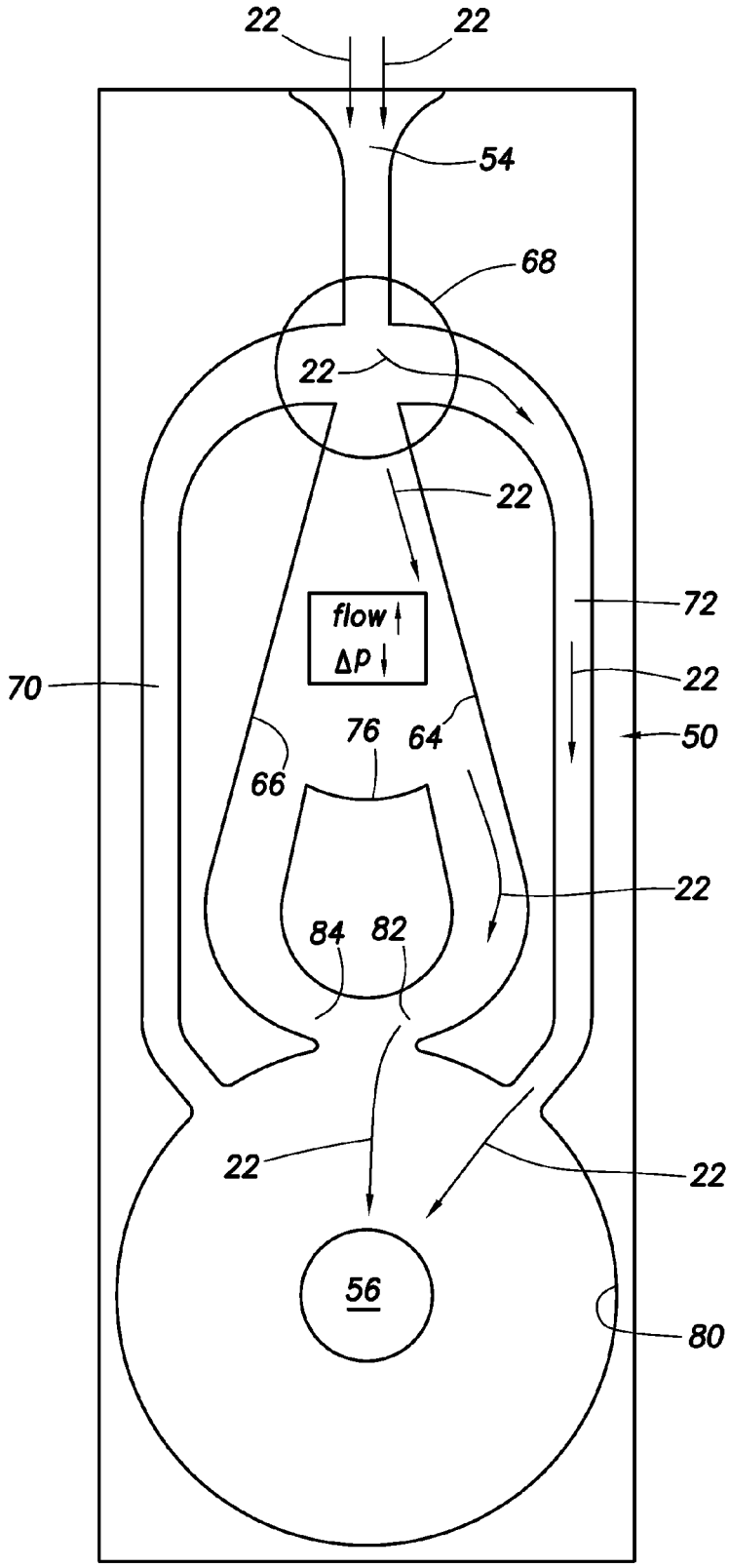

In FIG. 14, the vortex has dissipated in the chamber 80. The fluid 22 can now flow into the chamber 80 via the inlet 82 and the feedback fluid path 72.

The fluid 22 can flow substantially radially from the inlet 82 and feedback fluid path 72 to the output 56. Resistance to flow through the vortex chamber 80 is at its minimum. Pressure differential from the input 54 to the output 56 may be at its minimum. The flow rate of the fluid 22 through the fluidic oscillator 50 may be at its maximum.

Eventually, however, a vortex does form in the vortex chamber 80 and resistance to flow through the vortex chamber will thereby increase. As the strength of the vortex increases, the resistance to flow through the vortex chamber 80 increases, and the pressure differential from the input 54 to the output 56 increases and/or the rate of flow of the fluid 22 through the fluidic oscillator 50 decreases.

Figure 15:
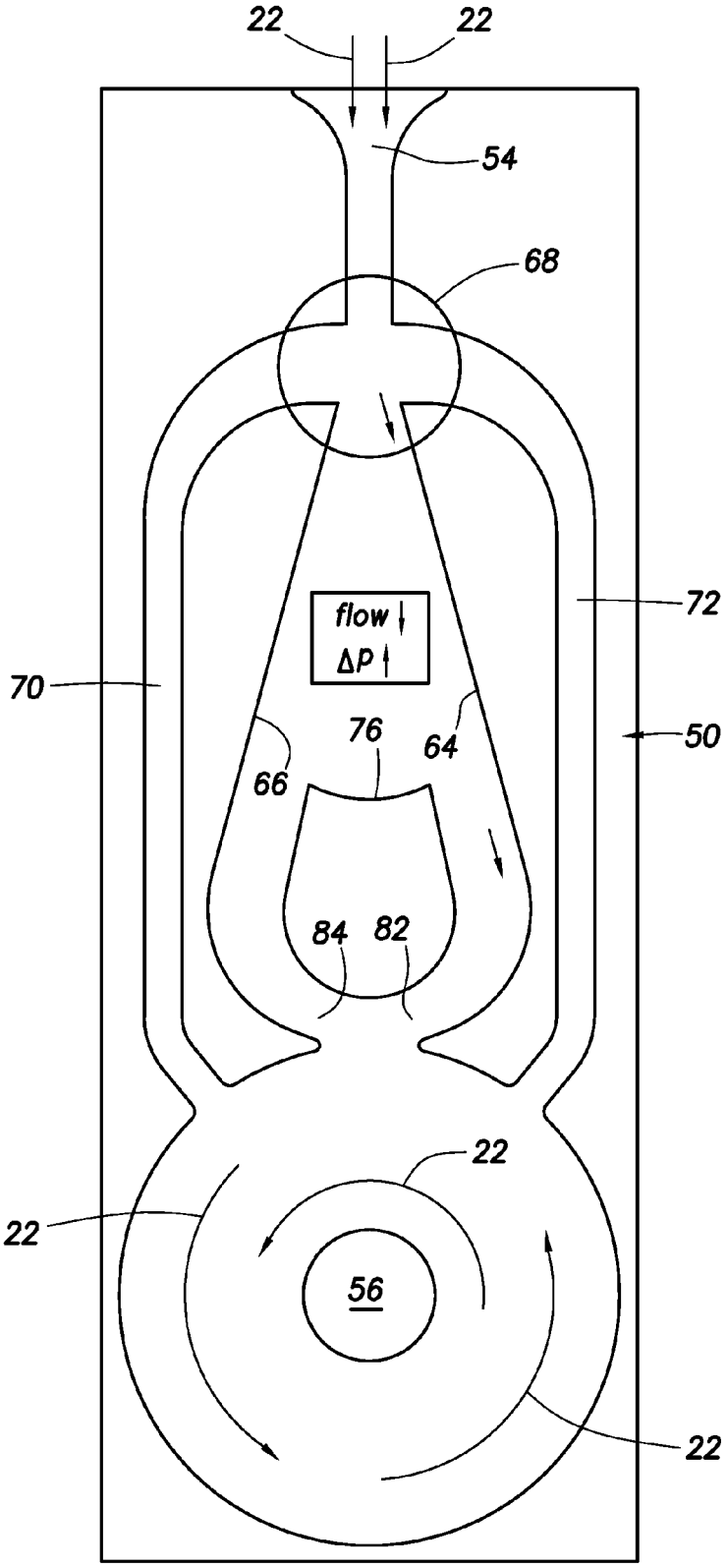

In FIG. 15, the vortex is at its maximum strength in the chamber 80. The fluid 22 flows substantially circumferentially about the chamber 80 (in a counter-clockwise direction as viewed in FIG. 15). Resistance to flow through the vortex chamber 80 is at its maximum.

Pressure differential from the input 54 to the output 56 may be at its maximum. The flow rate of the fluid 22 through the fluidic oscillator 50 may be at its minimum.

Eventually, however, due to the flow of the fluid 22 past the connection between the feedback fluid path 70 and the chamber 80, some of the fluid begins to flow from the fluid switch 68 to the chamber via the feedback fluid path. The fluid 22 also begins to flow adjacent the wall 66.

Figure 16:
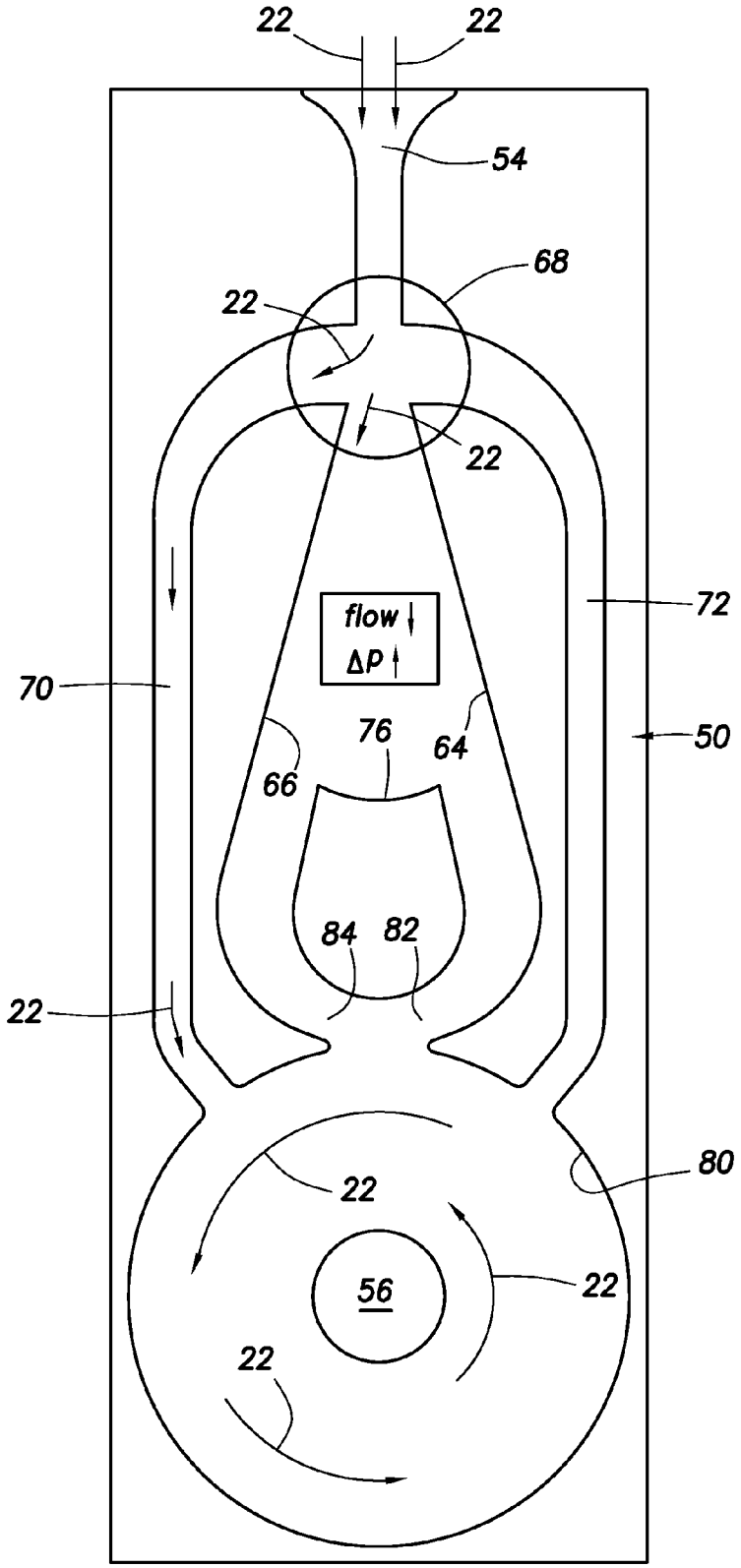

In FIG. 16, the vortex in the chamber 80 has begun to dissipate. As the vortex dissipates, the resistance to flow through the chamber 80 decreases.

Figure 17:
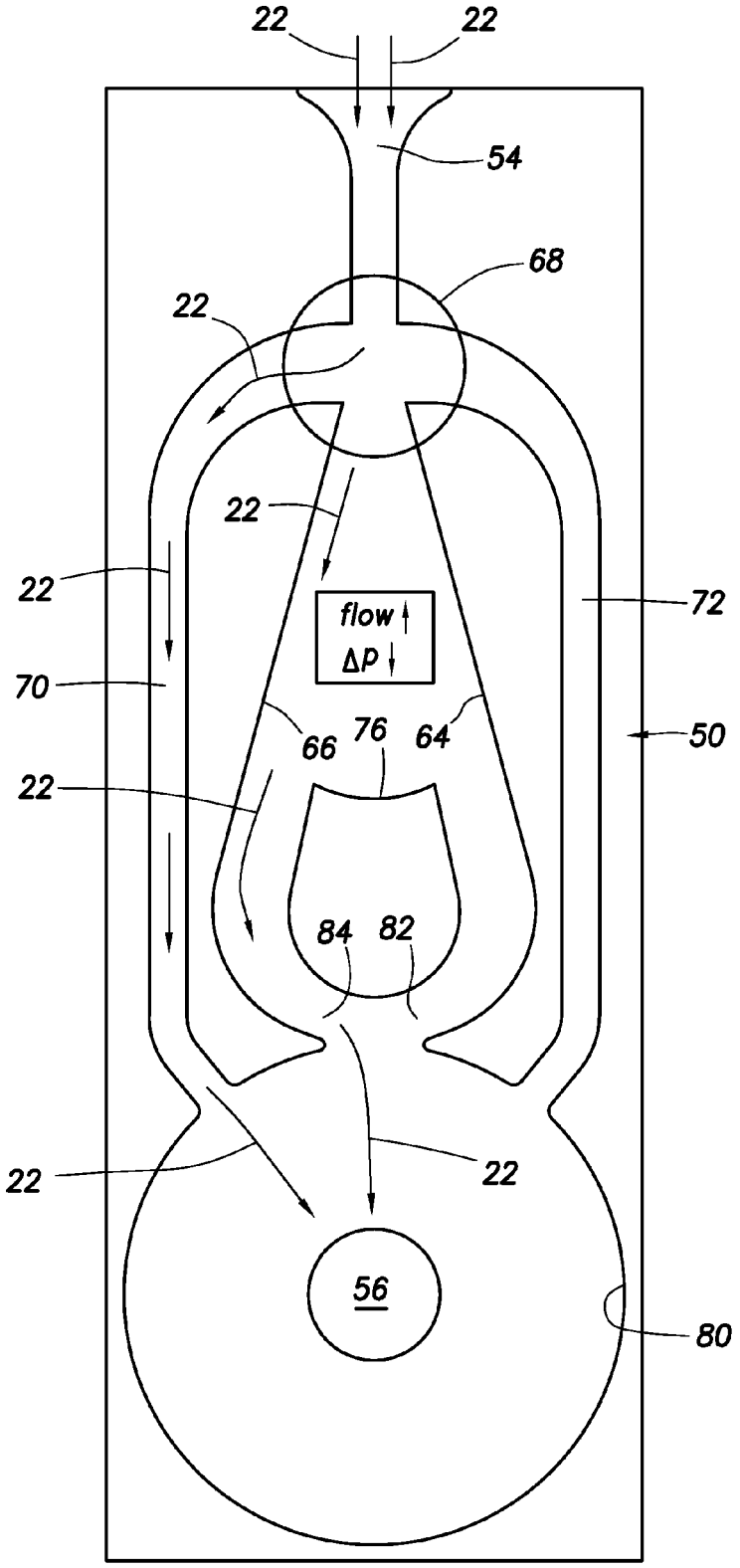

In FIG. 17, the vortex has dissipated in the chamber 80. The fluid 22 can now flow into the chamber 80 via the inlet 84 and the feedback fluid path 70.

The fluid 22 can flow substantially radially from the inlet 84 and feedback fluid path 72 to the output 56. Resistance to flow through the vortex chamber 80 is at its minimum. Pressure differential from the input 54 to the output 56 may be at its minimum. The flow rate of the fluid 22 through the fluidic oscillator 50 may be at its maximum.

Figure 18:
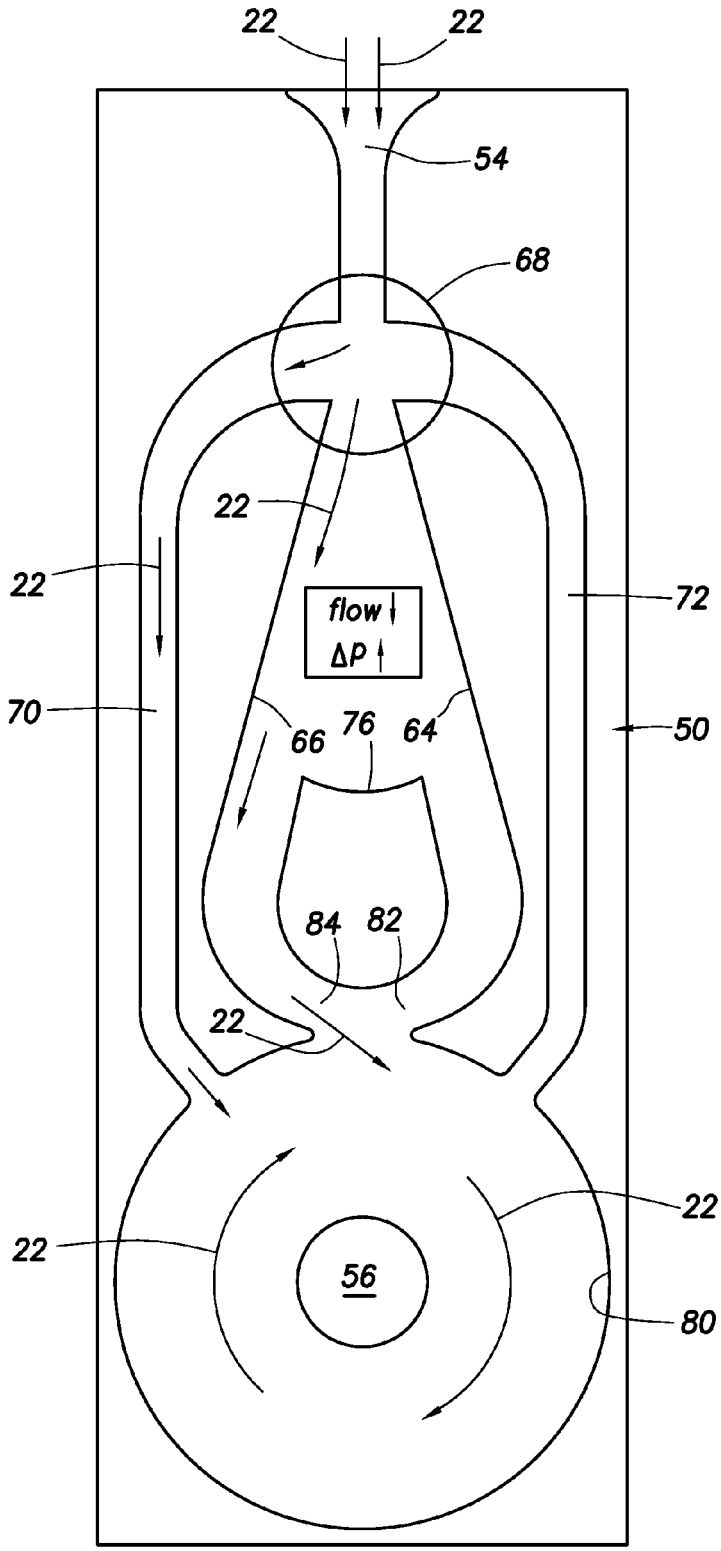

In FIG. 18, a vortex has formed in the vortex chamber 80 and resistance to flow through the vortex chamber thereby increases. As the strength of the vortex increases, the resistance to flow through the vortex chamber 80 increases, and the pressure differential from the input 54 to the output 56 increases and/or the rate of flow of the fluid 22 through the fluidic oscillator 50 decreases.

Figure 19:
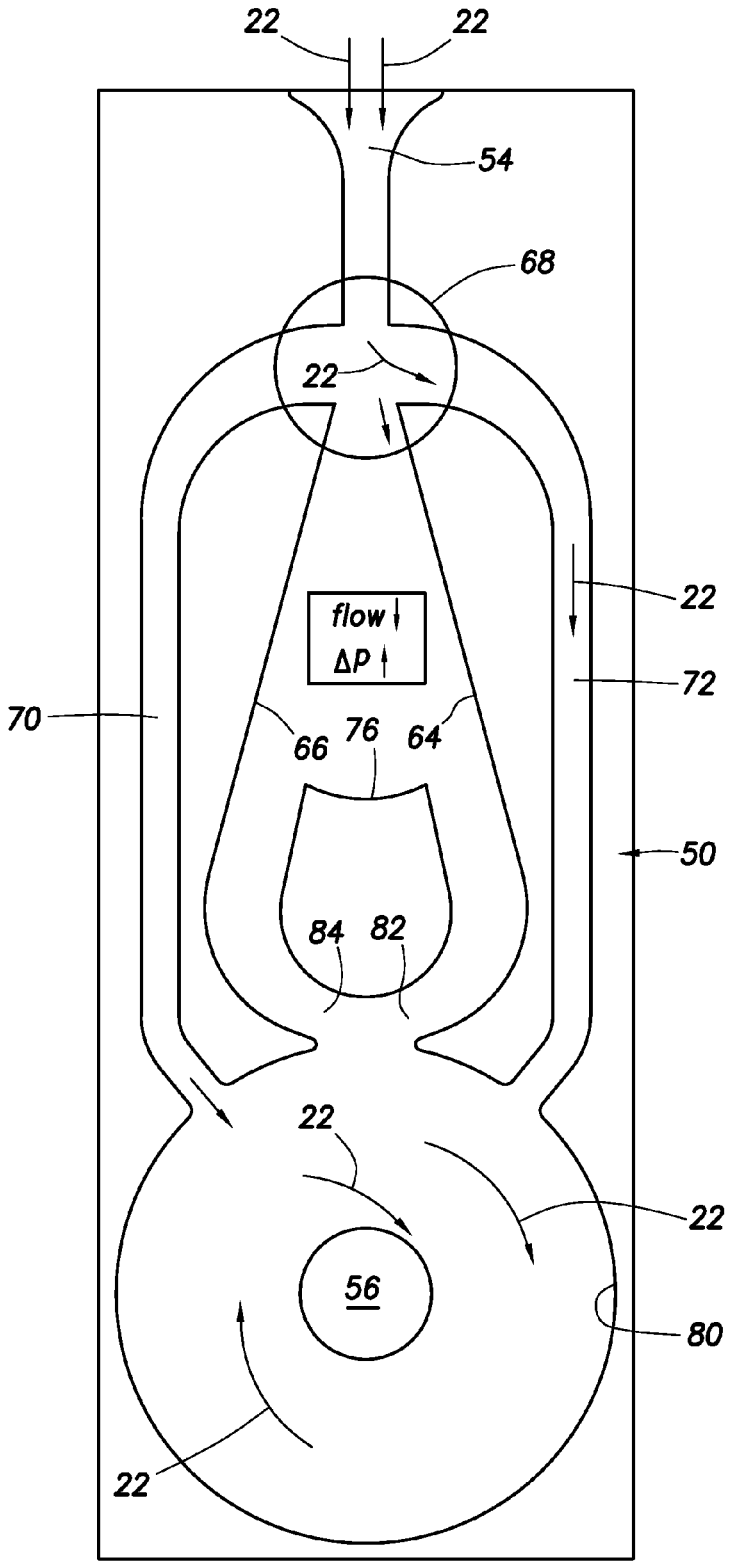

In FIG. 19, the vortex is at its maximum strength in the chamber 80. The fluid 22 flows substantially circumferentially about the chamber 80 (in a clockwise direction as viewed in FIG. 19). Resistance to flow through the vortex chamber 80 is at its maximum. Pressure differential from the input 54 to the output 56 may be at its maximum. The flow rate of the fluid 22 through the fluidic oscillator 50 may be at its minimum.

Flow through the fluidic oscillator 50 has now completed one cycle. The flow characteristics of FIG. 19 are similar to those of FIG. 13, and so it will be appreciated that the fluid 22 flow through the fluidic oscillator 50 will repeatedly cycle through the FIGS. 13-18 states.

In some circumstances (such as stimulation operations, etc.), the flow rate through the fluidic oscillator 50 may remain substantially constant while a pressure differential across the fluidic oscillator oscillates. In other circumstances (such as production operations, etc.), a substantially constant pressure differential may be maintained across the fluidic oscillator while a flow rate of the fluid 22 through the fluidic oscillator oscillates.

Figure 20:
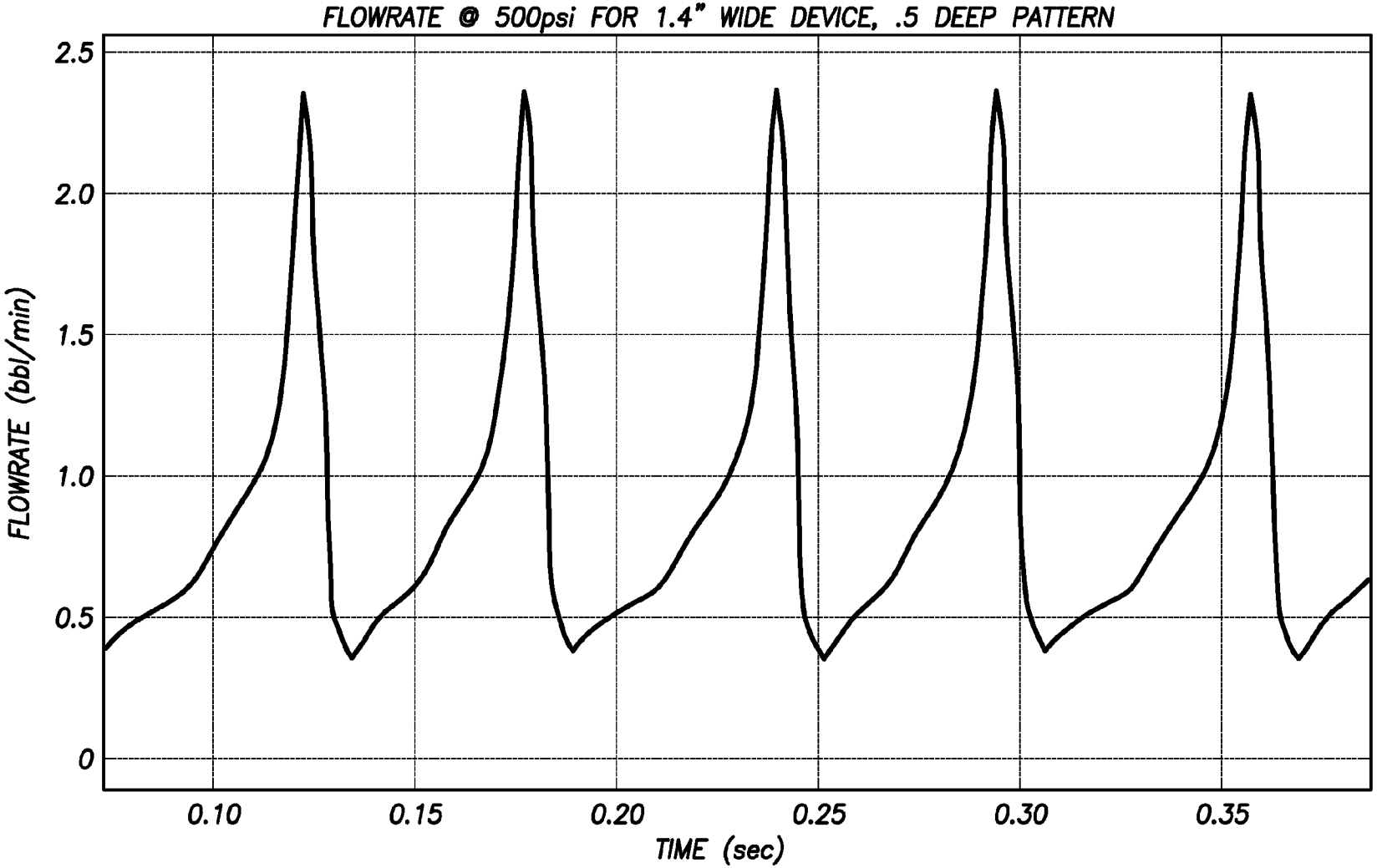
FIG. 20 is a representative graph of flow rate vs. time for an example of the fluidic oscillator.

Referring additionally now to FIG. 20, an example graph of flow rate vs. time is representatively illustrated. In this example, the pressure differential across the fluidic oscillator 50 is maintained at 500 psi, and the flow rate oscillates between about 0.4 bbl/min and about 2.4 bbl/min.

This represents about a 600% increase from minimum to maximum flow rate through the fluidic oscillator 50. Of course, other flow rate ranges may be used in keeping with the principles of this disclosure.

Experiments performed by the applicants indicate that pressure oscillations can be as high as 10:1. Furthermore, these results can be produced at frequencies as low as 17 Hz. Of course, appropriate modifications to the fluidic oscillator 50 can result in higher or lower flow rate or pressure oscillations, and higher or lower frequencies.

It may now be fully appreciated that the above disclosure provides several advancements to the art. The fluidic oscillators 50 described above can produce large oscillations of flow rate through and/or pressure differential across the fluidic oscillators. These oscillations can be produced high flow rates and low frequencies, and the fluidic oscillators 50 are robust and free of any moving parts.

The above disclosure provides to the art a fluidic oscillator 50 which can include a vortex chamber 80 with an output 56 and first and second inlets 82, 84, whereby fluid 22 enters the vortex chamber 80 alternately via the first and second inlets 82, 84, the first and second inlets 82, 84 being configured so that the fluid 22 enters the vortex chamber 80 in different directions via the respective first and second inlets 82, 84. A fluid switch 68 directs the fluid 22 alternately toward first and second flow paths 60, 62 in response to pressure differentials between first and second feedback fluid paths 70, 72. The first and second feedback fluid paths 70, 72 are connected to the vortex chamber 80.

The different directions in which the fluid 22 enters the chamber 80 via the inlets 82, 84 may be opposite directions. The different directions may be circumferential directions relative to the vortex chamber 80.

The first and second flow paths 60, 62 may cross each other between the fluid switch 68 and the output 56.

The fluid switch 68 may direct the fluid 22 toward the first flow path 60 when pressure in the first feedback fluid path 70 is greater than pressure in the second feedback fluid path 72. The fluid switch 68 may direct the fluid 22 toward the second flow path 62 when pressure in the second feedback fluid path 72 is greater than pressure in the first feedback fluid path 70.

The pressure differentials between the first and second feedback flow paths 70, 72 may reverse in response to the fluid 22 entering the vortex chamber 80 alternately via the first and second inlets 82, 84.

Also described above is a method in which a fluid 22 is flowed through a well tool 12. The well tool 12 can include a fluid input 54, a fluid output 56, and a fluidic oscillator 50 which produces oscillations in flow of the fluid 22. The fluidic oscillator 50 can include a vortex chamber 80 with first and second inlets 82, 84. Fluid 22 may enter the vortex chamber 80 alternately via the first and second inlets 82, 84. The first and second inlets 82, 84 may be configured so that the fluid 22 enters the vortex chamber 80 in different directions via the respective first and second inlets 82, 84. A fluid switch 68 may direct the fluid 22 alternately toward first and second flow paths 60, 62 in response to pressure differentials between first and second feedback fluid paths 70, 72.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "above," "below," "upper," "lower," etc., are used for convenience in referring to the accompanying drawings.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A fluidic oscillator, comprising:

a vortex chamber with an output and first and second inlets, whereby fluid enters the vortex chamber alternately via the first and second inlets, the first and second inlets being configured so that the fluid enters the vortex chamber in different directions via the respective first and second inlets;

a fluid switch which directs the fluid alternately toward first and second flow paths in response to pressure differentials between first and second feedback fluid paths; and the first and second feedback fluid paths being radially connected to the vortex chamber between the output and the first and second inlets.

2. The fluidic oscillator of claim 1, wherein the different directions are opposite directions.

3. The fluidic oscillator of claim 1, wherein the different directions are circumferential directions relative to the vortex chamber.

4. The fluidic oscillator of claim 1, wherein the first and second flow paths cross each other between the fluid switch and the output.

5. The fluidic oscillator of claim 1, wherein the fluid switch directs the fluid toward the first flow path when pressure in the first feedback fluid path is greater than pressure in the second feedback fluid path, and wherein the fluid switch directs the fluid toward the second flow path when pressure in the second feedback fluid path is greater than pressure in the first feedback fluid path.

6. The fluidic oscillator of claim 1, wherein the pressure differentials between the first and second feedback flow paths reverse in response to the fluid entering the vortex chamber alternately via the first and second inlets.

7. A method, comprising:

flowing a fluid through a well tool, the well tool comprising a fluid input, a fluid output, and a fluidic oscillator which produces oscillations in flow of a fluid, the fluidic oscillator including a vortex chamber with first and second inlets, whereby fluid enters the vortex chamber alternately via the first and second inlets, the first and second inlets being configured so that the fluid enters the vortex chamber in different directions via the respective first and second inlets, and a fluid switch which directs the fluid alternately toward first and second flow paths in response to pressure differentials between first and second feedback fluid paths, wherein the first and second feedback fluid paths are connected to the vortex chamber between the output and the first and second inlets.

8. The method of claim 7, wherein the first and second feedback fluid paths are radially connected to the vortex chamber.

9. The method of claim 7, wherein the different directions are opposite directions.

10. The method of claim 7, wherein the different directions are circumferential directions relative to the vortex chamber.

11. The method of claim 7, wherein the first and second flow paths cross each other between the fluid switch and the output.

12. The method of claim 7, wherein the fluid switch directs the fluid toward the first flow path when pressure in the first feedback fluid path is greater than pressure in the second feedback fluid path, and wherein the fluid switch directs the fluid toward the second flow path when pressure in the second feedback fluid path is greater than pressure in the first feedback fluid path.

13. The method of claim 7, wherein the pressure differentials between the first and second feedback flow paths reverse in response to the fluid entering the vortex chamber alternately via the first and second inlets.

14. A well tool, comprising:

a fluid input through which a fluid enters the well tool;

a fluid output through which the fluid exits the well tool; and a fluidic oscillator which produces oscillations in the fluid when the fluid flows from the input to the output, the fluidic oscillator including a vortex chamber with first and second inlets, whereby the fluid enters the vortex chamber alternately via the first and second inlets, the first and second inlets being configured so that the fluid enters the vortex chamber in different directions via the respective first and second inlets, and a fluid switch which directs the fluid alternately toward first and second flow paths in response to pressure differentials between first and second feedback fluid paths, the first and second feedback fluid paths being connected to the vortex chamber between the output and the first and second inlets.

15. The well tool of claim 14, wherein the first and second feedback fluid paths are radially connected to the vortex chamber.

16. The well tool of claim 14, wherein the different directions are opposite directions.

17. The well tool of claim 14, wherein the different directions are circumferential directions relative to the vortex chamber.

18. The well tool of claim 14, wherein the first and second flow paths cross each other between the fluid switch and the output.

19. The well tool of claim 14, wherein the fluid switch directs the fluid toward the first flow path when pressure in the first feedback fluid path is greater than pressure in the second feedback fluid path, and wherein the fluid switch directs the fluid toward the second flow path when pressure in the second feedback fluid path is greater than pressure in the first feedback fluid path.

20. The well tool of claim 14, wherein the pressure differentials between the first and second feedback flow paths reverse in response to the fluid entering the vortex chamber alternately via the first and second inlets.

* * * * *